US011027185B1

(12) United States Patent
LoDuca et al.

(10) Patent No.: US 11,027,185 B1
(45) Date of Patent: Jun. 8, 2021

(54) ROBOTIC BATTING TEE SYSTEM

(71) Applicant: Robosport Technologies LLC, Whitestone, NY (US)

(72) Inventors: Salvatore LoDuca, Whitestone, NY (US); Ted Larson, Santa Clara, CA (US); Zack Alban, Santa Clara, CA (US)

(73) Assignee: Robosport Technologies, LLC, Whitestone, NY (US)

( * ) Notice: Subject to any disclaimer, the term of this patent is extended or adjusted under 35 U.S.C. 154(b) by 0 days.

(21) Appl. No.: 17/013,196

(22) Filed: Sep. 4, 2020

(51) Int. Cl.
*A63B 69/00* (2006.01)
*A63B 59/00* (2015.01)
*A63B 102/18* (2015.01)

(52) U.S. Cl.
CPC ..... *A63B 69/0075* (2013.01); *A63B 69/0002* (2013.01); *A63B 2069/0008* (2013.01); *A63B 2102/182* (2015.10); *A63B 2220/40* (2013.01); *A63B 2220/805* (2013.01); *A63B 2220/833* (2013.01); *A63B 2225/093* (2013.01); *A63B 2225/20* (2013.01); *A63B 2225/50* (2013.01); *A63B 2225/74* (2020.08)

(58) Field of Classification Search
CPC ..... A63B 69/0075; A63B 69/0002; A63B 2069/0008; A63B 71/0622; A63B 69/002; A63B 71/0686; A63B 69/0071; A63B 69/0024
USPC ..... 473/417, 451, 422; 124/78, 79
See application file for complete search history.

(56) References Cited

U.S. PATENT DOCUMENTS

| | | | |
|---|---|---|---|
| 2,040,228 | A | 5/1936 | Whiteley |
| 3,006,647 | A | 10/1961 | Haskett |
| 3,144,104 | A | 8/1964 | Edward |
| 3,387,414 | A | 6/1968 | Adams |
| 3,529,823 | A | 9/1970 | Garver |

(Continued)

FOREIGN PATENT DOCUMENTS

| | | | |
|---|---|---|---|
| JP | 03037445 | A | 2/1991 |
| JP | 08-066502 | | 3/1996 |

(Continued)

OTHER PUBLICATIONS

Notice of Reasons for Refusal dated Jan. 28, 2014, in JP Patent Application No. 2012-21600411.

(Continued)

*Primary Examiner* — Mitra Aryanpour
(74) *Attorney, Agent, or Firm* — Akerman LLP

(57) ABSTRACT

A batting tee system includes a base, a first carriage moveably coupled to the base, and a second carriage moveably coupled to the first carriage. The second carriage may hold an external system having a neck and a ball holder. The batting tee system further includes a first actuator attached to the base, and a second actuator attached to the first carriage. The first actuator may move the first carriage and the second carriage along a first horizontal axis relative to the base. The second actuator may move the second carriage along a second horizontal axis relative to the base and the first carriage. The batting tee system further includes a control system that may cause the first carriage and the second carriage to move to random positions along the first horizontal axis and the second horizontal axis.

11 Claims, 9 Drawing Sheets

(56) References Cited

U.S. PATENT DOCUMENTS

| | | | | |
|---|---|---|---|---|
| 3,588,104 | A * | 6/1971 | Griffin | A63B 69/0079 473/424 |
| 3,589,632 | A | 6/1971 | Rew | |
| 3,608,844 | A | 9/1971 | Tumulty | |
| 3,940,132 | A | 2/1976 | Lopatto, III | |
| 4,161,313 | A | 7/1979 | Dickey | |
| 4,352,494 | A | 10/1982 | Wells | |
| 4,456,250 | A | 6/1984 | Perrone, Jr. | |
| 4,657,250 | A | 4/1987 | Newland | |
| 4,770,527 | A | 9/1988 | Park | |
| 4,815,735 | A * | 3/1989 | McClenny | A63B 69/0091 473/427 |
| 4,830,369 | A | 5/1989 | Poitras | |
| 4,834,375 | A | 5/1989 | Elstein | |
| 4,886,267 | A | 12/1989 | Licciardi | |
| 4,995,607 | A | 2/1991 | Whitfield | |
| 5,002,274 | A | 3/1991 | Bidema | |
| 5,046,729 | A | 9/1991 | Yancey | |
| 5,062,641 | A | 11/1991 | Poillon | |
| 5,160,131 | A | 11/1992 | Leon | |
| 5,228,683 | A | 7/1993 | Beimel | |
| 5,388,823 | A | 2/1995 | Prieto | |
| 5,401,016 | A | 3/1995 | Heglund et al. | |
| 5,413,175 | A | 5/1995 | Edmunds | |
| 5,551,204 | A | 9/1996 | Mayrand | |
| 5,590,876 | A | 1/1997 | Sejnowski | |
| 5,647,338 | A | 7/1997 | Martin | |
| 5,848,945 | A | 12/1998 | Miller | |
| 5,882,270 | A | 3/1999 | Daugherty | |
| 6,042,492 | A | 3/2000 | Baum | |
| 6,146,289 | A | 11/2000 | Miller et al. | |
| 6,167,878 | B1 | 1/2001 | Nickerson et al. | |
| 6,217,975 | B1 | 4/2001 | Daton-Lovett | |
| 6,256,938 | B1 | 7/2001 | Daton-Lovett | |
| 6,296,582 | B1 | 10/2001 | Minniear | |
| 6,443,859 | B1 | 9/2002 | Markin | |
| 6,551,205 | B1 | 4/2003 | Koetzer, Jr. | |
| 6,695,723 | B2 | 2/2004 | Leal | |
| 7,169,067 | B2 | 1/2007 | Town | |
| 7,294,071 | B1 | 11/2007 | Saumell | |
| 7,828,679 | B2 | 11/2010 | Tell et al. | |
| D633,583 | S | 3/2011 | Guervara | |
| 8,425,352 | B1 * | 4/2013 | Loduca | A63B 69/0079 473/418 |
| 8,597,141 | B1 | 12/2013 | Daniel | |
| 9,033,828 | B2 * | 5/2015 | LoDuca | A63B 69/0075 473/418 |
| 9,580,190 | B1 | 2/2017 | Spence | |
| 10,004,655 | B2 * | 6/2018 | Loduca | A61H 1/024 601/5 |
| 10,071,281 | B1 * | 9/2018 | Loduca | A63B 69/0002 473/417 |
| 10,071,284 | B1 * | 9/2018 | Loduca | A63B 69/0002 473/417 |
| 10,112,097 | B2 * | 10/2018 | LoDuca | A63B 69/0075 473/417 |
| 10,118,080 | B2 * | 11/2018 | Loduca | G09B 19/0038 463/3 |
| 10,160,555 | B2 | 12/2018 | Turse | |
| 10,497,278 | B2 * | 12/2019 | Loduca | G09B 19/0038 473/417 |
| 10,617,911 | B2 * | 4/2020 | LoDuca | A63B 69/0075 463/3 |
| 10,639,533 | B2 * | 5/2020 | LoDuca | A63B 69/0002 473/417 |
| 2001/0003106 | A1 | 6/2001 | Brenneisen | |
| 2003/0064836 | A1 | 4/2003 | Moss et al. | |
| 2005/0101418 | A1 | 5/2005 | Cech | |
| 2005/0130770 | A1 | 6/2005 | Baltisto | |
| 2005/0255945 | A1 | 11/2005 | Green | |
| 2007/0238554 | A1 | 10/2007 | Hu | |
| 2009/0082140 | A1 | 3/2009 | Liao | |
| 2012/0202621 | A1 | 8/2012 | Belt | |
| 2013/0061541 | A1 | 3/2013 | Taylor | |
| 2013/0095940 | A1 * | 4/2013 | Dugan | A63B 69/38 473/222 |
| 2013/0196793 | A1 | 8/2013 | Murphy | |
| 2013/0218308 | A1 | 12/2013 | Altschuler et al. | |
| 2014/0230949 | A1 | 8/2014 | Daton-Lovett | |
| 2015/0259911 | A1 | 9/2015 | Reebury | |
| 2015/0284955 | A1 | 10/2015 | Adams | |
| 2016/0325151 | A1 * | 11/2016 | Coyne | A63B 69/0002 473/417 |
| 2017/0298628 | A1 | 10/2017 | Rakow | |
| 2018/0056160 | A1 | 3/2018 | Loduca | |

FOREIGN PATENT DOCUMENTS

| | | |
|---|---|---|
| JP | 2000-504953 | 8/1997 |
| JP | 11-206164 A | 8/1999 |
| JP | 2007-136137 | 6/2007 |

OTHER PUBLICATIONS

Notice of Reasons for Refusal dated Jun. 16, 2014, in JP Patent Application No. 2012-216004.

10m 4" Single Mast/RolaCare System User Guide, v.2, May 2018.

The Rollable Composite Structural Technology, Enhancing Capatility Whilst Reducing Weight/Bulk and Time Burden—Expeditionary Systems; www.rolatube-expeditionary-systems.com, printed Jun. 22, 2018.

* cited by examiner

ROBOTIC BATTING TEE SYSTEM

TECHNICAL FIELD

The present disclosure is related to baseball/softball batting/hitting tees, more specifically the present disclosure is related to robotic or automated tees.

BACKGROUND

Hitting a baseball or softball is one of the most difficult skills of all sports to master. Attempts at mastery require batting practice, often taking the form of tee work. Indeed, tee work in baseball is heavily promoted, encouraged, and even mandated as a training tool at all levels of competition, from Little League to the Majors. The main purpose of tee work is to aid batters in maintaining consistent form in their swing path so that contact with the ball will produce line drive hits. Batting tees generally have a ball holder that extends from a home plate shaped support. The ball holder may be mounted along an adjustable neck allowing the player or coach to grasp the neck to adjust the height of the ball holder relative to the base shaped support and hence the ball when positioned on the holder. In use, a hitter takes stance adjacent to the tee and hits the ball off the ball holder.

SUMMARY

According to various embodiments, the present disclosure describes a batting tee system that seeks to shift the paradigm of tee work that historically defines "muscle memory" from a historical mode of "repetition" to a new methodology that embraces "randomization". By embedding randomization software, for example, within a robotic (mechanical) batting tee apparatus, batters can be prevented from sequentially hitting balls off of the tee in the same consecutive spot. This randomization approach prevents "locking in" a batters swing path or swing "groove" to a particular point or area within a batters strike zone. Hence, the methodology of randomization produces a contextual interference effect that drives enhanced flexibility and fluidity to make better contact anywhere in the strike zone and not just in areas where a batter feels they are most proficient (e.g., the batter's "hot zone"). It is believed that contextual interference and randomization modes as applied to sport specific training provides longer term learning patterns as well.

In one embodiment, a batting tee system includes a housing, a ball holder for holding a ball, and a neck movable along a vertical axis. The neck is attached at a first end to the housing, and is further attached at a second end to the ball holder. The batting tee system further includes an actuator positioned in the housing, and a control system. The actuator may move the neck along the vertical axis thereby increasing and decreasing a distance between the ball holder and the housing. The control system may cause (e.g., via electrical signals, hardware, programmed or programmable circuits, etc.) the actuator to move the neck to a first random position along the vertical axis, and may further cause the actuator to move the neck from the first random position to a second random position along the vertical axis, different than the first random position, after the ball is hit from the ball holder when the neck is in the first random position. The batting tee system also includes one or more connectors that may releasably couple the housing to an external system.

In another embodiment, a batting tee system includes a base, a first carriage moveably coupled to the base, and a second carriage moveably coupled to the first carriage. The second carriage may hold an external system having a neck and a ball holder. The batting tee system further includes a first actuator attached to the base, and a second actuator attached to the first carriage. The first actuator may move the first carriage and the second carriage along a first horizontal axis relative to the base. The second actuator may move the second carriage along a second horizontal axis relative to the base and the first carriage. The batting tee system further includes a control system that may cause (e.g., via electrical signals, hardware, programmed or programmable circuits, etc.) the first actuator to move the first carriage and the second carriage to a first random position along the first horizontal axis, and further cause the second actuator to move the second carriage to a first random position along the second horizontal axis. The control system may further cause the first actuator to move the first carriage and the second carriage from the first random position along the first horizontal axis to a second random position along the first horizontal axis, different than the first random position along the first horizontal axis, after a ball is hit from the ball holder when the first carriage and the second carriage are in the first random position along the first horizontal axis. The control system may also cause the second actuator to move the second carriage from the first random position along the second horizontal axis to a second random position along the second horizontal axis, different than the first random position along the second horizontal axis, after the ball is hit from the ball holder when the second carriage is in the first random position along the second horizontal axis.

While it is preferable that the actuator(s) cause movement from a random position to another random position, in some embodiments, the positions may not be random. For example, the positions may be selected by a user, and then the actuator(s) may move the neck, first carriage, and/or second carriage from a position selected by the user to another position selected by the user. As another example, the batting tee system(s) may also allow a user to apply physical force to the neck, first carriage, and/or second carriage so as to move the neck, first carriage, and/or second carriage from a position selected by the user to another position selected by the user.

BRIEF DESCRIPTION OF THE DRAWINGS

For a more complete understanding of the present disclosure and its features and advantages, reference is now made to the following description, taken in conjunction with the accompanying drawings, in which.

DESCRIPTION

Figure 1:
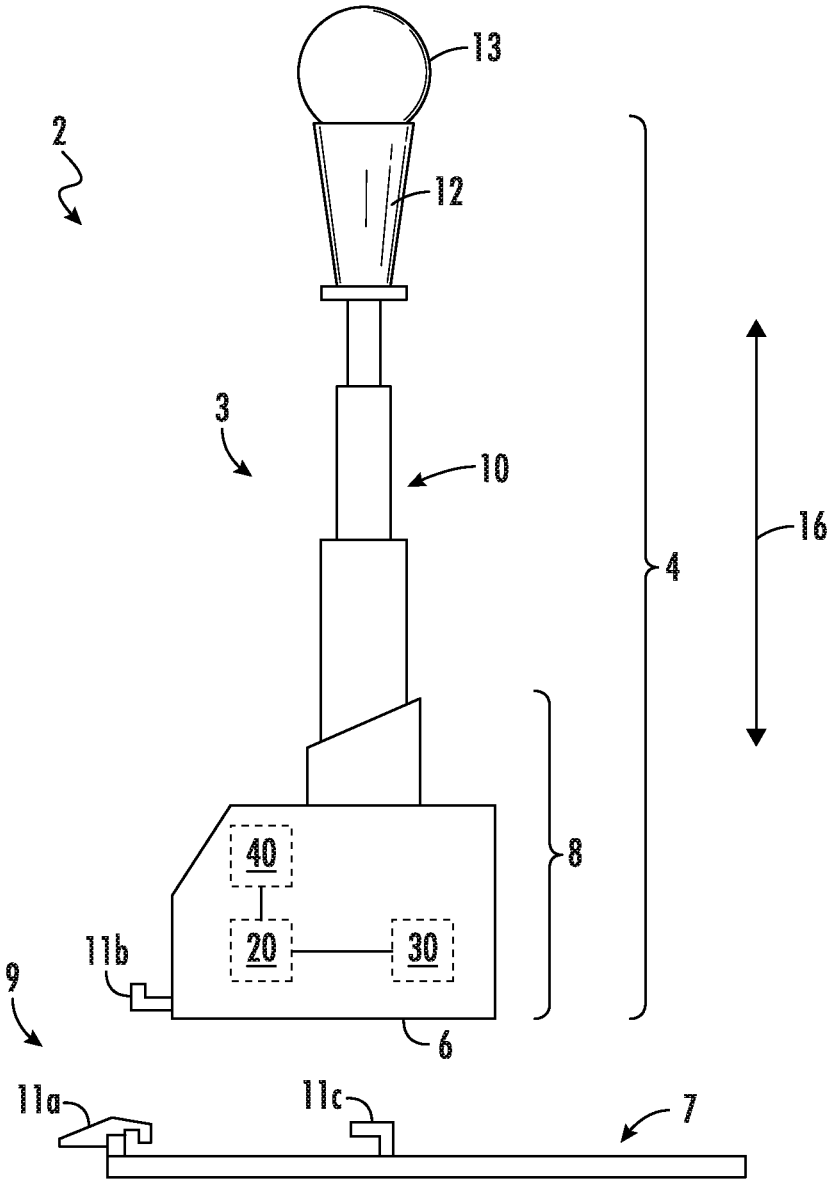
FIG. 1 is a side view of one embodiment of a tee system having a vertical tee system and a tee stand.

Batters participating in tee work will typically position a ball holder of a batting tee based on individual preferences for comfort or hot zones. Balls are repeatedly placed on the ball holder, hit, and replaced. This repetitious hitting of balls positioned at the same spot creates muscle memory or a proprioceptive-neurological pathway that locks in a motor muscular swing path or groove to a particular spot within the strike zone. In baseball, batters have milliseconds to perceive an incoming pitch and square up by positioning their arms and hands to meet the center of the ball with the barrel of the bat. When batters require motor muscular flexibility in the game to meet an incoming pitch, their swing path will automatically and involuntarily be driven to a positional spot where a baseball has been hit hundreds or thousands of times during tee work. Hence, the swing path becomes preprogrammed, seemingly more robotic than robots themselves.

When using a tee, typically the ball will be repetitively replaced on the ball holder positioned at the same height even where the height of the ball holder may be adjusted by grasping the neck and physically extending or shortening the neck. In these instances, the batter is repeatedly hitting the ball in the same spatial plane, which provides little resolution to train to the fullest flexibility within the strike zone. Furthermore, to represent various locations in the strike zone, typically, the tee must be manually moved to and from the inner (e.g., left), outer (e.g., right), front, or back portions of the strike zone. Such manual movement may be inconvenient, which tends to cause the tee to not be moved (or moved very infrequently). In these instances, the batter is repeatedly hitting the ball at the same area in the strike zone, which also provides little resolution to train to the fullest flexibility within the strike zone.

Without being bound to theory, it is believed that the brain works in a paradoxical manner with respect to hitting. That is, while the brain prefers repetition (utilizing brain pathways most often used or of least resistance) it can only learn when it is stretched (fostering neural plasticity) or presented with unfamiliar or novel experiences ("opening" and "activating" dormant or unused neural pathways). In this respect, traditional tee usage may actually inhibit rather than foster hand-eye coordination.

A tee system is described herein which may be used to teach consistent good contact, with consistent good form, anywhere in the strike zone, not just where a batter feels most proficient. The tee system may be configured to position a ball holder at various heights along a vertical axis (i.e., z-axis). Movement of the ball holder between the height positions along the vertical axis may be automated (robotic). The selection of the height positions may also be automated. For example, a control system may be programmed with height position data used to execute selection of height positions. The height position data may include one or more sequences of height positions. The height position data may include one or more generated sequences of random height positions. The number of height positions in a sequence or number of sequences may be large enough such that a batter is unlikely to perceive or unconsciously key in on height positions as to anticipate repetition over multiple exposures to the sequence. Sequences may be associated with ranges of heights, which may be selected by a user. In some instances, the control system may be configured to skip height positions within a sequence that are outside a range set by a user. The control system may also be programmed to generate height position data comprising random height positions within a range of height positions.

The tee system may also (or alternatively) be configured to position a ball holder at various positions along two horizontal axes, such as an in-out axis (i.e., x-axis) and a front-back axis (i.e., y-axis). Movement of the ball holder between the positions along the horizontal axes may be automated (robotic). The selection of the horizontal (i.e., in-out, front-back) positions may also be automated. For example, a control system may be programmed with horizontal position data used to execute selection of horizontal positions. The horizontal position data may include one or more sequences of horizontal positions. The horizontal position data may include one or more generated sequences of random horizontal positions. The number of horizontal positions in a sequence or number of sequences may be large enough such that a batter is unlikely to perceive or unconsciously key in on the horizontal positions as to anticipate repetition over multiple exposures to the sequence. Sequences may be associated with ranges of horizontal positions, which may be selected by a user. In some instances, the control system may be configured to skip horizontal positions within a sequence that are outside a range set by a user. The control system may also be programmed to generate horizontal position data comprising random horizontal positions within a range of horizontal positions.

The tee system and components for use with tee systems are described further below with reference to FIGS. 1-9, wherein like numerals are used to identify like features.

Figure 2:
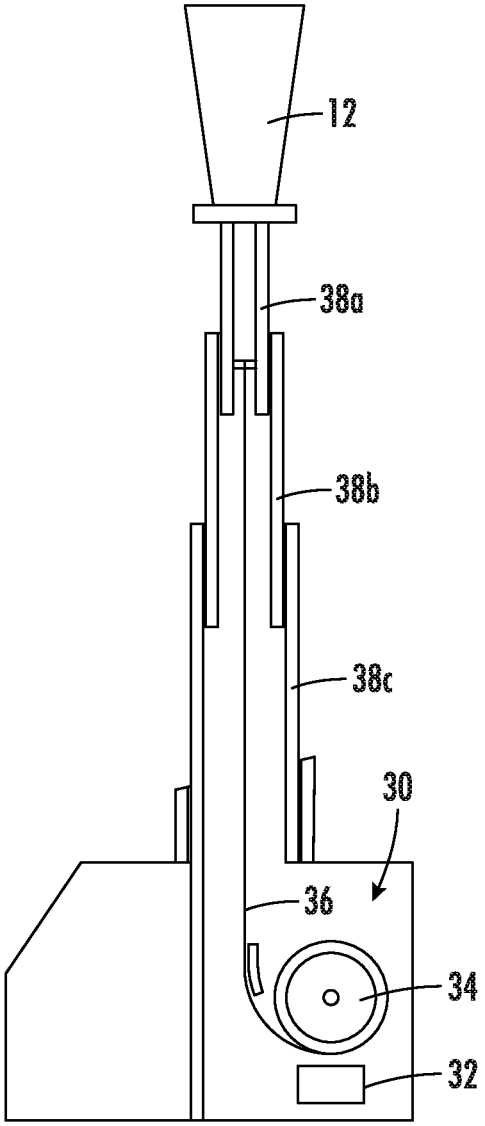
FIG. 2 is a partial cross-sectional view illustrating an actuator and neck of the vertical tee system of FIG. 1.
Figure 3:
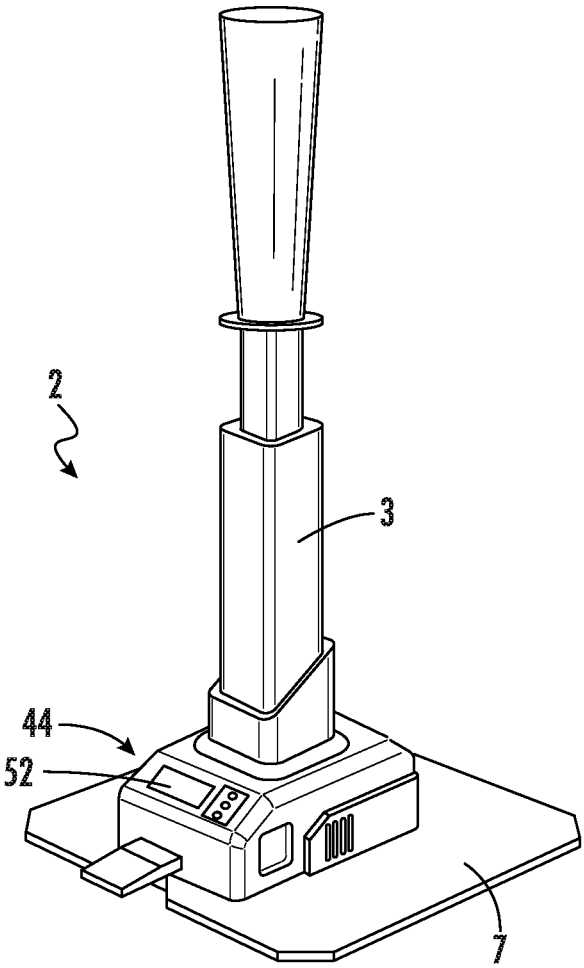
FIG. 3 is a perspective view of the tee system of FIG. 1 where the vertical tee system is removeably coupled to the tee stand.

With reference to FIGS. 1-3, in various embodiments, the tee system 2 includes a vertical tee system 3 configured to position a ball holder 12 at various heights along a vertical axis 16. The vertical tee system 3 includes a body 4 comprising a housing 8, a neck 10 extendable and retractable from the housing 8, and a ball holder 12 positioned on the neck 10.

The vertical tee system 3 is preferably configured to be man-portable (e.g., weighing 12 pounds or less, in some embodiments) yet stable enough to prevent falling over due to a mishit from a batter. For example, the bottom portion 6 of the housing 8 may provide a stable platform for mounting of the neck 10, ball holder 12, and other components without adding unnecessary weight to the vertical tee system 3. The housing 8 may include a handle (not shown) dimensioned to be gripped by a user for transporting the vertical tee system 3. The housing 8 may have a footprint of between 12 inches and 24 inches around the center of the neck 10. In some embodiments, the bottom portion 6 of the housing 8 may be wider than the remainder of the housing 8, longer than the remainder of the housing 8, or both to provide stability. The bottom portion 6 may include a rubber-like lower surface to increase friction with the ground surface upon which the body 4 of the vertical tee system 3 may be placed.

The neck 10 may be formed of a rigid material that is durable to withstand mishits. For example, the neck 10 may be constructed of metals or hard plastics (e.g., a combination of metal and HDPE plastic tubes). In one embodiment, the neck 10 includes a topple feature wherein a strong mishit causes the top of the neck 10 to pivot downward to prevent breaking the neck 10 or toppling the vertical tee system 3.

The neck 10 extends between the housing 8 at a first end and mounts the ball holder 12 at a second end. The neck 10 is movable along the vertical axis 16 (indicated by a double arrow). Extension or retraction of the neck 10 with respect to the housing 8 may be robotically driven. For example, the vertical tee system 3 may include a robotically extendable and retractable neck 10 with respect to the housing 8 operable to adjust the height of the ball holder 12 and, hence, a ball 13 when positioned on the ball holder 12. Extension or retraction of the neck 10 may also be manual. For example, the user may manually extend or retract the neck 10 using physical force. In various embodiments, the body 4 includes a housing 8 that can completely encase the neck 10 after use. For example, the neck 10 may include a telescopic piston that may be folded or enveloped into the housing 8 for storage. In other embodiments, a portion of the neck 10 may remain outside of the housing 8 after use.

As is illustrated in FIG. 2, the neck 10 may comprise telescoping sections 38 that move along the vertical axis 16. These telescoping sections 38 (e.g., 38*a*, 38*b*, 38*c*) may cause the length of the neck 10 to increase (thereby increasing the distance between the ball holder 12 and the housing 8) when the ball holder 12 is moved to a higher vertical position, or they may cause the length of the neck 10 to decrease (thereby decreasing the distance between the ball holder 12 and the housing 8) when the ball holder 12 is moved to a lower vertical position.

The neck 10 may include any number of telescoping sections 38. As is illustrated, the neck 10 includes three telescoping sections 38. The innermost telescoping section 38*a* may be coupled to the ball holder 12, thereby mounting the ball holder 12 to the body 4 of the vertical tee system 3. In some embodiments, the innermost telescoping section 38*a* may be an inner molded 80A silicone rubber tube. The middle telescoping section 38*b* may be coupled to the innermost telescoping section 38*a* at a first end, and may be further coupled to an outermost telescoping section 38*c* at a second end. In some embodiments, the middle telescoping section 38*b* may be an inner molded 80A silicone rubber tube. The outermost telescoping section 38*c* may be coupled to the middle telescoping section 38*a* at a first end, and may be further coupled to the housing 8 at a second end. In some embodiments, the outermost telescoping section 38*c* may be an inner molded 80A silicone rubber tube.

As is illustrated, the telescoping sections 38 may be nestable. As an example of this, when the neck 10 is retracted downwards toward the housing 8, all or a portion of the middle telescoping section 38*b* may retract inside the outermost telescoping section 38*c*, and/or all or a portion of the innermost telescoping section 38*a* may retract inside the middle telescoping section 38*b* (and the outermost telescoping section 38*c*). In some embodiments, the outermost telescoping section 38*c* may not move relative to the housing 8. That is, it may remain fixed in place while the innermost telescoping section 38*a* and/or the middle telescoping section 38*b* move relative to the outermost telescoping section 38*c*. In other embodiments, the outermost telescoping section 38*c* may move relative to the housing 8.

In other embodiments, the neck 10 may not include telescoping sections 38. As an example, of this, the neck 10 may include a single section 38 that moves upward and downward relative to the housing 8 (thereby increasing or decreasing the distance between the ball holder 12 and the housing 8). In such an example, the length of the neck 10 may remain the same. when the neck 10 is actuated along the vertical axis 16 to move upward or downward. This may cause the distance between the ball holder 12 and the housing 8 to be proportional to the length of the neck 10 retracted into and extended from the housing 8.

The ball holder 12 may hold the ball 13, such as a baseball or softball. The ball holder 12 may be constructed of a durable plastic or rubber-like plastic or polymer, such as thermoplastic polyurethane (TPU). In various embodiments, the ball holder 12 may include three or more prongs that may hold the ball 13. In one example, the prongs are adjustable to modify the size of the ball holder 12 to provide holding capabilities for larger and smaller balls. In some embodiments, the ball holder 12 is modular such that it may be removed and replaced to replace worn components or customize the ball holder 12. The ball holder 12 may therefore be interchangeable with other ball holders 12. In some embodiments, a first ball holder 12 may be used to hold a baseball, and a second ball holder 12 may be used to hold a softball. These first and second ball holders 12 may be interchangeable, so as to allow a user to practice with either a baseball or a softball. In other embodiments, the ball holder 12 may be sized (or configured) to hold both a baseball and a softball. As such, the ball holder 12 may not need to be changed in order to practice with either a baseball or softball. As described in more detail below, in some embodiments, the ball holder 12 may include sensors. As such, a user may interchange ball holders 12 to mount a ball holder 12 that adds, upgrades, or removes features. In some embodiments, certain ball holders 12 may not be interchangeable in-whole or in-part.

The vertical tee system 3 may be coupled to a power source to provide power to the vertical tee system 3. For example, the vertical tee system 3 may be powered by a power source comprising one or more batteries, an a/c outlet, or combination thereof. In the illustrated embodiment, the vertical tee system 3 includes an onboard (associated with or mounted on the body 4) rechargeable battery 20 of the SLA or LiPo type. This rechargeable battery 20 may be removed, re-charged, and replaced (or changed to an entirely new battery), in some embodiments. In other embodiments, the body 4 may include a socket or plug configured to couple to an a/c outlet to recharge the battery 20.

The vertical tee system 3 may also include an actuator 30 that may move the neck 10 along the vertical axis 16. The actuator 30 may be any type of system that may move the neck 10 along the vertical axis 16. For example, the actuator 30 may be a mechanical system, an electro-mechanical system, a hydraulic system, a pneumatic system, or any other system that may move the neck 10 along the vertical axis 16. As an example of this, the actuator 30 may include a pneumatic or hydraulic chamber and a piston movable through the chamber when hydraulic fluid or gas is pumped (via a pump) into or out of the chamber. The neck 10 may extend from or otherwise be coupled to the movement from the piston to thereby move the neck 10 along the vertical axis 16. An another example, the actuator 30 may include a motor that transmits rotational or linear force to the neck 10, causing the neck 10 to move along the vertical axis 16.

FIG. 2 illustrates another example of an actuator 30 according to one embodiment. As is illustrated, the actuator 30 may include one or more motors 32, a spool 34, and one or more linkages 36. The motors 32, spool 34, and linkages 36 may be housed in the housing 8. The motor(s) 32 may be any powered motor. For example, the motor(s) 32 may comprise an electric, hydraulic, or pneumatic motor. As is illustrated, the motor 32 includes a reversible electric motor. The motor(s) 32 may transmit a force onto the spool 34, causing the spool 32 to rotate. The spool 32 may be coupled to the one or more linkages 36, and the linkages 36 may be coupled to the neck 10. As is illustrated in FIG. 2, the linkage(s) 36 are coupled to the innermost telescoping section 38*a* of the neck 10. The spool 34 may be any type of spool that rotates when a force is applied by the motor(s) 32. For example, the spool 34 may be a motor anchored flex tape spool. The linkage(s) 36 may be any type of linkage(s) that may be coupled to both the neck 10 and the spool 34. As is illustrated, the linkage(s) 36 may include plastic tape (e.g., semi-flexible plastic tape coupled to the spool 34, and rigid center tube tape coupled to the innermost telescoping section 38*a*). In such an example, the actuator 30 may be a tape drive system. In other examples, the linkages 36 may include gearing that interfaces with gears of the spool 34.

In operation, when the spool 32 rotates (due to being driven by the motor 32) in a first direction (e.g., clockwise), the linkages 36 may push upward on the innermost telescoping section 38*a*, causing the innermost telescoping section 38*a* to move upward relative to the housing 8. When the spool 32 rotates in a second direction (e.g., counterclockwise), the linkages 36 may pull downward on the innermost telescoping section 38*a*, causing the innermost telescoping section 38*a* to move downward relative to the housing 8. These movements may cause the neck 10 to telescopically extend and retract when engaged by the actuator 30 (e.g., similar to a powered telescoping antenna).

The actuator 30 may be operable to move the neck 10 along the vertical axis 16 within a range extending approximately 20 inches, approximately 25 inches, approximately 30 inches, approximately 35 inches, or more. For example, the actuator 30 may be operable to move the neck 10 within a height range taken between the lower side of the bottom portion 6 and the top side of the ball holder 12 of approximately 17 inches (but not to exceed approximately 20 inches, in some embodiments) when the neck 10 is fully retracted, to approximately 44 inches when the neck 10 is fully extended. The actuator 30 may move the neck 10 at any speed. For example, the actuator 30 may move the neck at a speed of approximately 4 inches per second, although other actuation rates may be used. In some embodiments, the actuator 30 may move the neck 10 at a speed that allows the neck 10 to reach the next random height position within approximately 5 seconds of the ball being hit off the ball holder 12.

Figure 4:
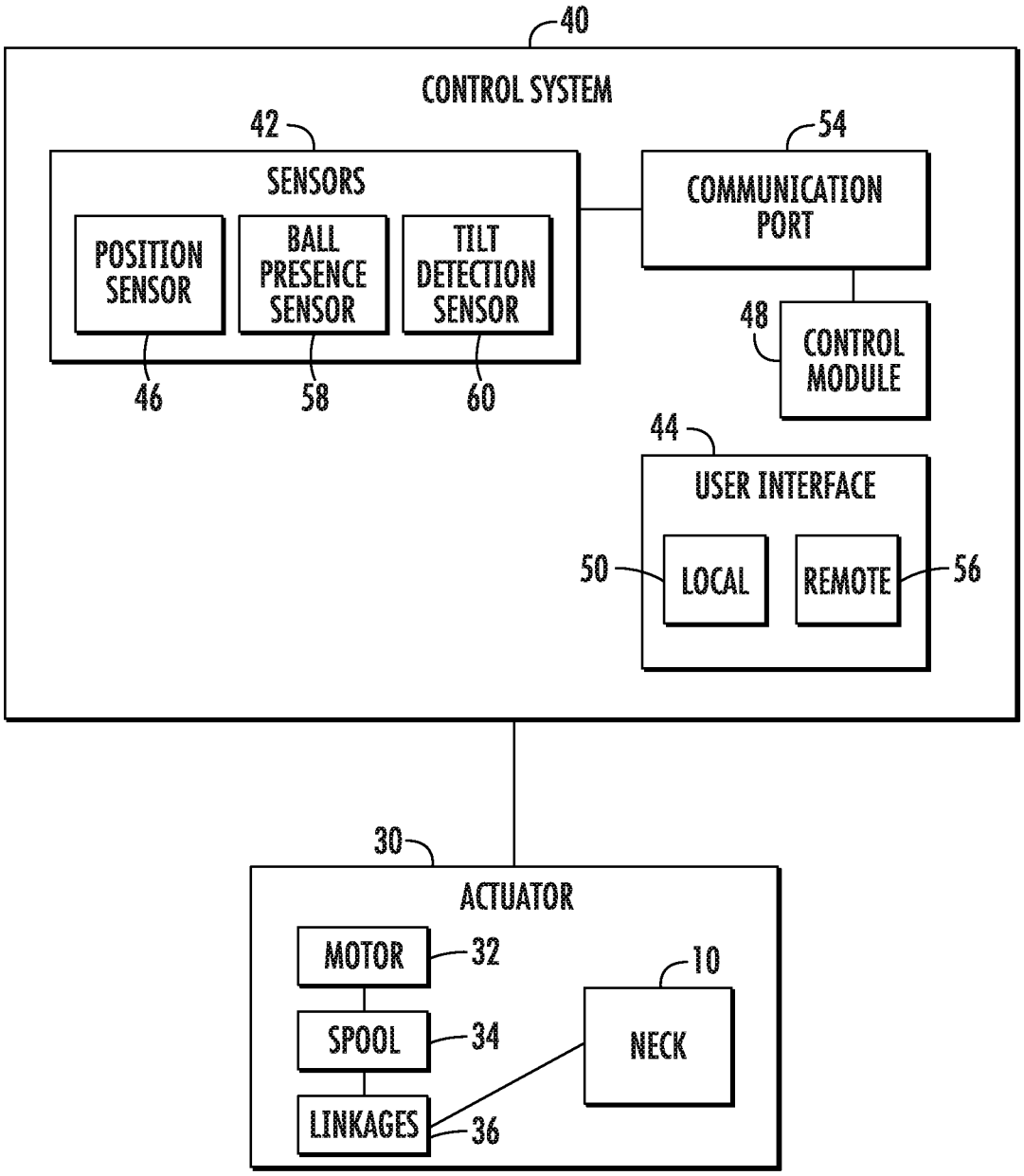
FIG. 4 schematically illustrates various operational features of the vertical tee system of FIG. 1.

Referring again to FIG. 1, in various embodiments, the vertical tee system 3 includes a control system 40 operable to control the operations of the vertical tee system 3. With further reference to FIG. 4, schematically illustrating features of the control system 40 according to various embodiments, the control system 40 may provide for actuation (motor control) of the movement of the neck 10 along the vertical axis 16, sensing using sensors 42, and a user interface 44 for interfacing the user with the operations of the control system 40. For example, the control system 40 may include sensors 42 comprising position sensors 46 (or be configured to receive, via wired or wireless communication, position data from one or more position sensors 46) positioned to collect position data that may be used by the control system 40 to determine a position corresponding to the position of the neck 10 or ball holder 12. In some embodiments, the control system 40 and actuator 30 comprise a servomechanism. In one embodiment, the position sensor 46 includes a potentiometer to monitor the rotation of a disc drive of the motor 32 which corresponds to the neck 10 height position. The potentiometer may be a multi-turn potentiometer, for example, providing for simple determination of the height of the neck 10 or ball holder 12 at any point in time after being powered ON. In this or another embodiment, the control system 40 incorporates a stepper motor or servomotor configured with position control incorporating an encoder or potentiometer in a closed loop. In some embodiments, a slotted disc may be placed on the drive pin of the motor 32, before the gear reduction. A photointerruptor may sense the slots of the disc, thus creating a motor encoder. The output of this motor encoder may be used to provide feedback to the classical control loops regulating motor speed and tee height. The control system 40 may also include a PID controller, for example, to receive and interpret the position data and provide corresponding control signals to control operation of the actuator 30.

In various embodiments, the control system 40 includes a control module 48. The control module 48 may include a processor configured to execute instructions, which may be hardwired into the processor. The control module 48 may also include memory for storing instructions executable by the processor. For example, the control module 48 may comprise a microcontroller chip with general purpose I/O. Operational embedded software may be programmed to detect the presence of balls using sensor data, generate random heights to position the neck 10 through the closed-loop control system 40, and allow user interaction via the user interface 44. The control module 48 may also include a microcontroller board to interface with the actuator 30, sensors 42 and input devices, and perform high level control of the vertical tee system 3. The control system 40 may also include a height selection switch. For example, the neck 10 may be actuated along the vertical axis 16 within a height range. A 3-way/5-way position switch, for example, may be used as an input device to select an appropriate height zone. This switch may be connected to the microcontroller board and the software may be programmed to generate random positions within the height zone selected by a user at the user interface 44 or using a predetermined zone range. Other switch mechanisms may be used. In one embodiment, the height range may be between 17" to 48" (and more particularly between 20" and 44") taken between the ball holder 12 and bottom portion 6 of the housing 8.

The user interface 44 may include a local user interface 50 providing operations such as height range selector switch, default movement, etc. In one example, a user, at the local user interface 50, may specify a height zone within the range within which the control system 40 is to actuate the neck 10 (e.g., random heights within the range). The user interface 44 may include 4 capacitive touch buttons to assist in specifying the height zone for a particular user. The user may touch an UP and DOWN button to move the neck 10 up and down. When the neck 10 is in the desired location, the user may touch a SET STRIKE ZONE button to indicate that this point should be the bottom of the strike zone. Similarly, the user will be able to move the stand to another point and set that as the top of the strike zone using the SET STRIKE ZONE button. The set strike zone may be saved for that user. This saved strike zone may be retrieved whenever the user is using the vertical tee system 3. For example, the user interface 44 may allow a user to select a particular user account from a list. In some embodiments, RFID tags and a reader may be used by the vertical tee system 3 to identify particular users and retrieve the saved strike zone for a particular user.

The local user interface 50 may include a display 52 (shown in FIG. 3). The display 52 may include LED indicators to inform the user about the operational state of the vertical tee system 3, for example a red LED may indicate actuation (e.g., when the neck 10 is about to move, is moving, or both), and a green LED may indicate the neck 10 is properly positioned or the neck 10 is properly positioned along with the ball in the ball holder 12. Additional LEDs may indicate the status of the battery 20 (e.g., full, low)

The control system 40 may also include a communication port 54, which may include multiple communication ports 54. The communication port 54 may include a receiver, transmitter, transceiver, etc. The communication port 54 may be configured to allow communication between the control system 40 and other devices, such as sensors 42, external or remote devices or interfaces 44 (e.g., an accessory device, wired or wirelessly coupled to the communication port 54, such as a remote). For example, the communication port 54 may comprise a transceiver configured for wired communication, wireless communication, or both. In one embodiment, the communication port 54 is configured for wireless communication such as Bluetooth, IR, Wi-Fi, radio, etc. The communication port 54 may transmit operational data to a remote device such as a computer, laptop computer, tablet, smart phone/device, or dedicated remote device to provide a remote interface 56.

The communication port 54 may be configured for communicating with external or remote devices using Bluetooth. For example, the communication port 54 may include Bluetooth communication hardware to wirelessly pair the control system 40 with an external or remote device such as a remote controller, smart phone, hearing device, tactile-vibration feedback device, or combination thereof. Thus, the user, using a mobile application running on a mobile device may use the remote interface 56 to remotely set the minimum and maximum height, or range, within which the actuator 30 will randomly move the neck 10. Similarly, a user may use the local interface 50 on the body 4 to set the minimum and maximum height, or range, that the actuator 30 will move the neck 10. In one embodiment, the remote user interface 56 or local user interface 50 is configured to allow a user to program a particular sequence of heights.

A randomization software package may be embedded in the control system 40 so that the actuator 30 does not move the neck 10 to the same position consecutively. The software package may include a random height generator operable to generate random heights within a defined range. As noted above, in one embodiment, the control system 40 may be programmed with random height sequences that may be executed during operation of the vertical tee system 3. In one embodiment, the control system 40 will not allow a user to keep the neck 10 at the same height for more than one hit with the idea that a batter should not hit a ball in the same consecutive spot.

In one embodiment, the user interface 44 may be programmed to suggest a batter not keep the body 4 in any one position for more than a certain number or range of balls (e.g., 5 to 10 hit balls). The batter may input how many balls he may want to hit with the body 4 in any one position. Once that number of hits is reached, the control system 40 may emit a signal to the batter to move the body 4 to another position around the plate to get maximum resolution within the cubical area of a batters particular strike zone. In some embodiments, a user may utilize the local user interface 50 or the remote user interface 56 (e.g., a smart phone application) to create a pre-set number of positions for the ball holder 12. In such an example, the control system 40 may randomly circulate through the pre-set positions (as opposed to generating random positions).

In some embodiments, a user may utilize the local user interface 50 or the remote user interface 56 (e.g., a smart phone application) to control the position of the ball holder 12. In such an example, the position may not be random. Instead, the position may be input by the user into the local user interface 50 or the remote user interface 56 (e.g., pressing the UP or DOWN buttons, entering a particular height, downloading or entering a set of heights, etc.), thereby allowing the user to select the position of the ball holder 12. The ball holder 12 may then be moved to that position by the vertical tee system 3. In some embodiments, the user may select the position (and cause the ball holder 12 to be moved to that position) at any time. For example, the user may select the position (and cause the ball holder 12 to be moved to that position) after the ball has been hit from the ball holder 12, while the ball is still on the ball holder 12, or at any other time.

In various embodiments, the control system 40 includes sensors 42 positioned to detect ball data. Example sensors 42 may include sensors 42 to detect ball position, ball hit, or vibration for estimating the speed of the ball. In a further example, such detection may be achieved through an embedded processor integrated with an accelerometer and an IR proximity sensor. One or more of the sensors 42 may be located along the neck 10 or ball holder 12, for example. The sensors 42 may be wired to the control module 48 or may be configured for wireless communication with the control module 48. For example, in one embodiment, a microprocessor module is integrated with one or more of the sensors 42 and a Bluetooth interface and is configured for communication with the control module 48. When received by the control module 48, which may be located in the body 4, the ball data may be used by the control module 48 to signal placement of a new ball on the ball holder 12 or to initiate movement of the neck 10 to the next position. The control module 48 may also display data obtained from the ball data on display 52 of the local user interface 50 or transmit the data to an external or remote device, such as a paired mobile device or computer running an application of the vertical tee system as a remote user interface 56.

In various embodiments, the sensors 42 include a ball presence sensor 58 to detect presence of the ball. The sensor 58 may be used to determine when a ball has been hit to know when to move the neck 10 to the next random location. The ball presence sensor 58 may incorporate any suitable sensor technology. For example, the ball presence sensor 58 may detect vibration or movement of the ball holder 12, movement of a ball from the ball holder 12, weight of or weight change with respect to the ball holder 12, light or optical sensors, sound sensors, or other suitable sensors. In one embodiment, the ball presence sensor 58 may include an IR proximity line-of-sight sensor used to detect the presence of a ball on the ball holder 12. In some embodiments, the ball presence sensor 58 may include an IR range finder constructed from an IR LED and IR photodiode. In such an embodiment, the ball presence sensor 58 may be housed in a soft TPU container with holes for the LED and photodiode, and it may be mounted in the innermost telescoping section 38*a*. The ball presence sensor 58 can also be used to detect idle/no activity time, in which the vertical tee system 3 may switch off or go into a low power sleep mode to conserve power. The ball presence sensor 58 may also be able to detect false positives (e.g., a user waving their hand over the ball holder 12, as opposed to a ball being positioned on the ball holder 12). To do so, the ball presence sensor 58 (or the control module 48) may wait approximately 0.5 seconds before registering the presence of the ball.

In one embodiment, the sensors 42 include a tilt detection sensor 60. The tilt detection sensor 60 may include an accelerometer, for example, to detect tilt data. The tilt detection sensor 60 may be mounted in the body 4. When the control module 48 receives tilt data from the tilt detection sensor 60 that indicates that the tee has fallen over, the control system 40 may be configured to stop the motor 32 from moving the neck 10 to avoid damage to the actuator 30. The control system 40 may also be configured such that the vertical tee system 3 is operational only when the body 4 is upright.

In some embodiments, sensors 42 may include more than one position sensor 46, more than one ball presence sensor 58, and/or more than one tilt detection sensor 60. For example, sensors 42 may include two position sensors 46, two ball presence sensors 58, and/or two tilt detection sensors 60. The additional sensors 42 may provide a fail-safe system that allows the control system 40 to still receive data even when a sensor 42 fails. For example, if a first ball presence sensor 58 fails, the second ball presence sensor 58 may still detect the presence of the ball and transmit that detection data to the control system 40. The additional sensors 42 may be the same type of sensor 42 as the first, or they may be different. For example, both ball presence sensors 58 may be IR proximity line-of-sight sensors. In another example, the first ball presence sensor 58 may be an IR proximity line-of-sight sensor, and the second ball presence sensor 58 may be a weight sensor or a vibration sensor.

In one embodiment, the vertical tee system 3 is a compact, standalone, one axis, robotic tee having a telescoping neck 10. The telescoping neck 10 is configured to extend to a minimum height of 18 inches and a maximum height of 48 inches off the ground. The vertical tee system 3 is low weight for easy positioning and transport. The control system 40 controls the actuator 30 such that the telescoping neck 10 may be moved to a particular random height that is set between the minimum and maximum height that is pre-programmed into the control system 40 at the user interface 44. The user places a ball on the tee and hits. An appropriate ball presence sensor 58 collects ball presence data which is used by the control module 48 to determine that the ball was hit. The control module 48 then initiates the actuator 30 to move the neck 10 along the vertical axis 16 to another random spot. Once a session is finished, the control system 40 or actuator 30 may move the telescopic neck 10 down the vertical axis 16 to become fully or partially encased in the housing 8, creating ease of usage, set up, storage, and portability.

As is discussed above with regard to FIGS. 1-3, the bottom portion 6 of the housing 8 (itself) may provide a stable platform for mounting of the neck 10, ball holder 12, and other components. That is, the bottom portion 6 may provide stability to the vertical tee system 3, so as to prevent the vertical tee system 3 from falling over due to a mishit from a batter.

In some embodiments, the vertical tee system 3 may be coupled to a tee stand 7 (as is illustrated in FIGS. 1 and 3). The tee stand 7 may provide additional stability to the vertical tee system 3, so as to further prevent the vertical tee system 3 from falling over due to a mishit from a batter.

The tee stand 7 may have any shape and/or size that allows it to provide additional stability to the vertical tee system 3. For example, the tee stand 7 may be shaped as a square, rectangle, a circle, a baseball or softball home plate, any other shape, or any combination of the preceding. The tee stand 7 may be wider than the housing 8, longer than the housing 8, or both to provide additional stability. The tee stand 7 may include a rubber-like lower surface to increase friction with the ground surface upon which the tee stand 7 may be placed.

The vertical tee system 3 may be coupled to a tee stand 7 using one or more connectors 9. The connectors 9 may be any type of connector that may couple the vertical tee system 3 to the tee stand 7. For example, the connectors 9 may be a clip system, a magnetic connector system, bolts and nuts, a threaded connector system that allows the vertical tee system 3 to be screwed into the tee stand 7, adhesives, bolts, compression fittings, brackets, a rail and groove system, a clamp system, any other type of connector, or any combination of the preceding.

As is illustrated, the connectors 9 are a quick release clip system. The quick release clip system may include a latch 11*a*, a first bracket 11*b*, and a second bracket 11*c*. To connect the vertical tee system 3 to the tee stand 7, the second bracket 11*c* may be positioned in a groove (not shown) in the bottom portion 6 of the housing 8. Also, the first bracket 11*b* may be positioned underneath the latch 11*a*, and the latch 11*a* may then be closed over the first bracket 11*b*. This may allow the vertical tee system 3 to snap into connection with the tee stand 7 with relative ease and stay locked even under forces hitting the tee until the mechanical release is actuated. To release the vertical tee system 3 from the tee stand 7, the above process may be reversed. As is illustrated, the latch 11*a* and the second bracket 11*c* are included on the tee stand 7, while the first bracket 11*b* is included on the body 4 of the vertical tee stand 3. In other embodiments, the latch 11*a* and the second bracket 11*c* may be included on the body 4 of the vertical tee stand 3, while the first bracket 11*b* may be included on the tee stand 7.

In some embodiments, the connectors 9 may releasably couple the vertical tee system 3 to the tee stand 7. In such embodiments, the vertical tee system 3 may be temporarily coupled to the tee stand 7, and then the vertical tee system 3 may be removed from the tee stand 7. This coupling and removal may occur any number of times. In some embodiments, when the vertical tee system 3 is removed, it may be used by itself (i.e., without the tee stand 7 or any other external device). That is, a user may place the bottom portion 6 of the housing 8 of the vertical tee system 3 on a ground surface, and the vertical tee system 3 will remain stable while in use. In other embodiments, the vertical tee system 3 may only be used (i.e., it may only remain stable) when the vertical tee system 3 is coupled to the tee stand 7 (or other external device). In some embodiments, the connectors 9 may further releasably couple the vertical tee system 3 to a horizontal tee system 64, as is discussed below.

Figure 5:
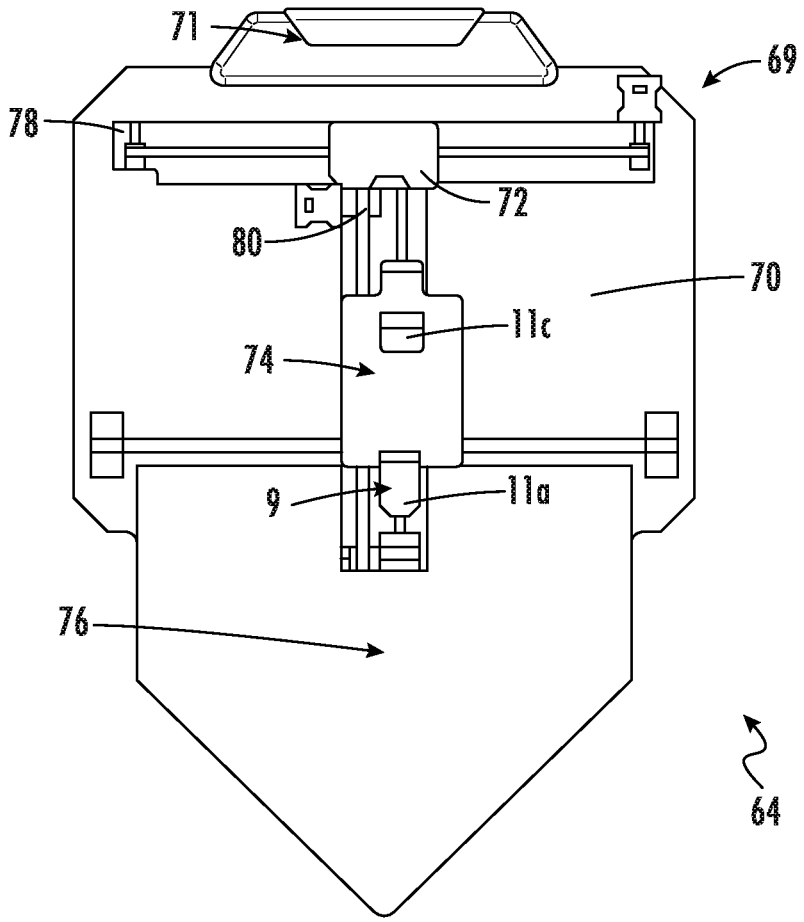
FIG. 5 is a top view of one embodiment of a tee system having a horizontal tee system.
Figure 6:
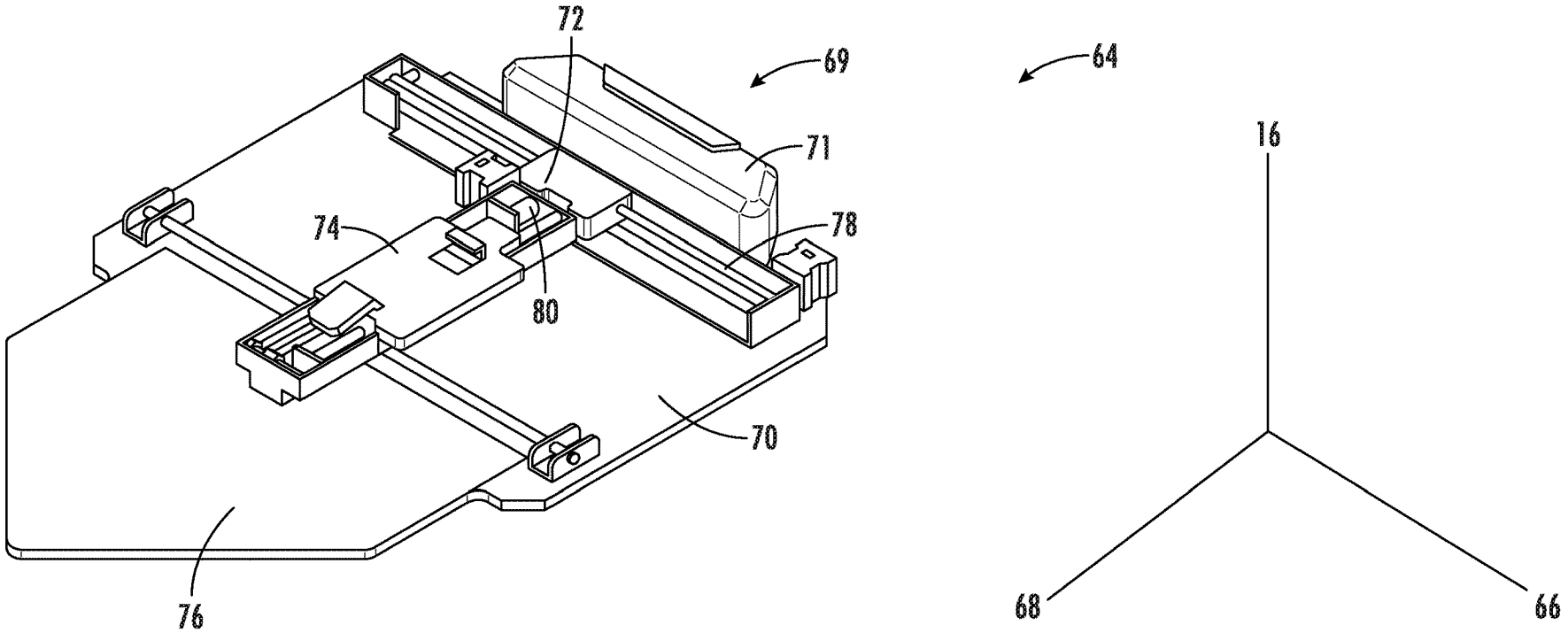
FIG. 6 is a perspective view of the horizontal tee system of FIG. 5.
Figure 7:
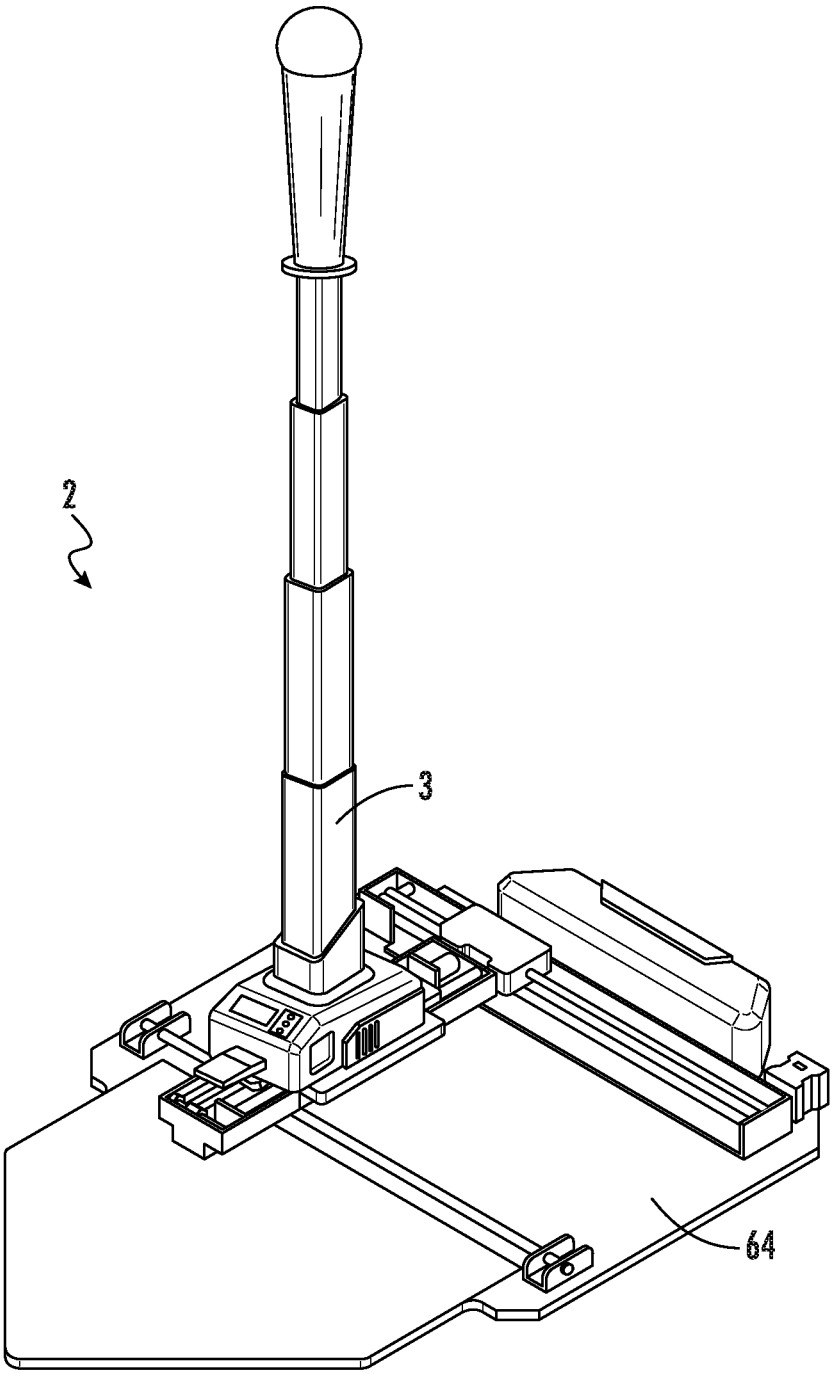
FIG. 7 is a perspective view of one embodiment of a tee system having the vertical tee system of FIG. 1 coupled to the horizontal tee system of FIG. 5.

As is illustrated in FIGS. 5-7, the tee system 2 may further include a horizontal tee system 64. The horizontal tee system 64 is configured to position the ball holder 12 of the vertical tee system 3 (and the remainder of the body 4 of the vertical tee system 3) at various positions along two horizontal axes: the in-out axis 66 (i.e., x-axis) and the front-back axis 68 (i.e., y-axis). As is illustrated, the horizontal tee system 64 includes a body 69 comprising a base 70, a housing 71, an in-out carriage 72 movable along the in-out axis 66 (shown in FIG. 6) relative to the base 70, and a front-back carriage 74 movable along the front-back axis 68 (shown in FIG. 6) relative to the base 70.

The horizontal tee system 64 is preferably configured to be man-portable (e.g., weighing 12 pounds or less, in some embodiments, without the vertical tee system 3). Furthermore, the horizontal tee system 64 may include a handle (not shown) dimensioned to be gripped by a user for transporting the horizontal tee system 64. The base 70 may provide stability to the horizontal tee system 64, thereby preventing the horizontal tee system 64 (and the attached vertical tee system 3) from falling over due to a mishit from a batter. The base 70 may be shaped as a square, rectangle, a circle, a baseball or softball home plate, any other shape, or any combination of the preceding. The base 70 may have a footprint that does not exceed approximately 34" long and 24" wide, in some embodiments. The base 70 may include a rubber-like lower surface to increase friction with the ground surface upon which the horizontal tee system 64 may be placed.

In some embodiments, the horizontal tee system 64 may include a base plate 76 that is releasably coupled to the base 70. The base plate 76 may be shaped as a baseball or softball home plate. In use, the base plate 76 may be placed on the ground surface or atop an existing home plate. The base plate 76 may be removed from the base 70. When this occurs, the base 70 may be placed atop an existing home plate (or adjacent the home plate, or on a ground surface).

The horizontal tee system 64 may further include the housing 71. The housing 71 may be coupled to the base 70, and may house one or more electronic and/or mechanical components of the horizontal tee system 64. For example, one or more motors, drivers, processing units, memory units, and battery units may be enclosed (fully or partially) within the housing 71.

The horizontal tee system 64 may further include the in-out carriage 72 configured to hold the front-back carriage 74 (which is configured to hold the vertical tee system 3). This holding causes the in-out carriage 72 to support (i.e., carry) the front-back carriage 74 and prevent the front-back carriage 74 from falling off the horizontal tee system 64.

The in-out carriage 72 may be moveably coupled to the base 70, and is movable along the in-out axis 66 relative to the base 70. This allows the in-out carriage 72 to move back and forth between the left-side of the strike zone and the right-side of the strike zone. By connection, it also allows the front-back carriage 74, the ball holder 12 of the vertical tee system 3, and hence the ball 12, to move back and forth between the left-side of the strike zone and the right-side of the strike zone. Movement of the in-out carriage 72 may be robotically driven. For example, the horizontal tee system 64 may include a robotically movable in-out carriage 72 operable to adjust the left-and-right position (i.e., the inside-and-outside position) of the ball holder 12 and, hence, the ball when positioned on the ball holder 12. Movement of the in-out carriage 72 may also be manual. For example, the user may manually move the in-out carriage 72 using physical force.

The in-out carriage 72 may be moveably coupled to the base 70 in any manner that allows the in-out carriage 72 to move along the in-out axis 66. For example, as is illustrated, the in-out carriage 72 may be moveably coupled to the base 70 by a rail system (e.g., a first rail positioned adjacent the front of the base 70 and a second rail positioned adjacent the back of the base 70). This rail system may be connected to the base 70. The in-out carriage 72 may slide along the length of the rail system back and forth along the in-out axis 66.

The horizontal tee system 64 may further include the front-back carriage 74 configured to hold the vertical tee system 3. This holding causes the front-back carriage 74 to support (i.e., carry) the vertical tee system 3 and prevent the vertical tee system 3 from falling off the horizontal tee system 64.

The front-back carriage 74 may be moveably coupled to the in-out carriage 72, and is movable along the front-back axis 68 relative to the base 70 (and in the in-out carriage 72). This allows the front-back carriage 74 to move back and forth between the front-side of the strike zone and the back-side of the strike zone. By connection, it also allows the ball holder 12 of the vertical tee system 3, and hence the ball 12, to move back and forth between the front-side of the strike zone and the back-side of the strike zone. Movement of front-back carriage 74 may be robotically driven. For example, the horizontal tee system 64 may include a robotically movable front-back carriage 74 operable to adjust the front-and-back position of the ball holder 12 and, hence, the ball when positioned on the ball holder 12. Movement of the front-back carriage 74 may also be manual. For example, the user may manually move the front-back carriage 74 using physical force.

The front-back carriage 74 may be moveably coupled to the in-out carriage 72 in any manner that allows the front-back carriage 74 to move along the front-back axis 68. For example, as is illustrated, the front-back carriage 74 may be moveably coupled to the in-out carriage 72 by a rail system (e.g., a first rail positioned adjacent the left side of the in-out carriage 72 and a second rail positioned adjacent the right-side of the in-out carriage 72). This rail system may be connected to the in-out carriage 72. The front-back carriage 74 may slide along the length of the rail system back and forth along the front-back axis 68.

As is discussed above, the front-back carriage 74 may be held by the in-out carriage 72 (e.g., via the moveable coupling). This may cause the front-back carriage 74 to move when the in-out carriage 74 moves. That is, the front-back carriage 74 may ride on or in the in-out carriage 72 as the in-out carriage 72 moves along the in-out axis 66. As such, the front-back carriage 74 moves along the in-out axis 66 (as a result of being carried by in-out carriage 72), and the front-back carriage 74 also moves along the front-back axis 66 (as a result of the moveable coupling). In connection, this allows the ball holder 12 of the vertical tee system 3, and hence the ball 12, to move back and forth between the left-side of the strike zone and the right-side of the strike zone, and to also move back and forth between front of the strike zone and the back of the strike zone.

Although the in-out carriage 72 is described as holding the front-back carriage 74 and the front-back carriage 74 is described as holding the vertical tee system 3, in some examples their roles and positioning may be reversed. For example, the front-back carriage 74 may hold the in-out carriage 72 (and also may be moveably coupled to the base 70), and the in-out carriage 72 may hold the vertical tee system 3 (also may be moveably coupled to the front-back carriage 74).

The horizontal tee system 64 may be coupled to a power source to provide power to the horizontal tee system 64. For example, the horizontal tee system 64 may be powered by a power source comprising one or more batteries, an a/c outlet, or combination thereof. In the illustrated embodiment, the horizontal tee system 64 is powered via a powered connection between the horizontal tee system 64 and the vertical tee system 3. For example, the horizontal tee system 64 may include a pogo-pin connection (not shown), such as a 4 pin independent pogo-pin connection, that connects to the vertical tee system 3. This pogo-pin connection may be used to supply power from the vertical tee system 3 to the horizontal tee system 64 when the vertical tee system 3 is mounted on the horizontal tee system 64.

The horizontal tee system 64 may also include an in-out actuator 78 operable to move the in-out carriage 72 along the in-out axis 66 relative to the base 70. This allows the in-out carriage 72 (and hence the ball holder 12 of the vertical tee system 3 and the ball 13) to move back and forth between the left-side of the strike zone and the right-side of the strike zone. The in-out actuator 78 may be any type of system that may move the in-out carriage 72 along the in-out axis 66. For example, the in-out actuator 78 may be a mechanical system, an electro-mechanical system, a hydraulic system, a pneumatic system, or any other system that may move the in-out carriage 72 along the in-out axis 66. As is illustrated, the in-out actuator 78 may be a mechanical belt system that moves the in-out carriage 72 along the in-out axis 66. This mechanical belt system may include a belt (such as a timing belt) connected to two or more rotating shafts. The movement of the mechanical belt system may be automatically driven by one or more motors 79 (shown in FIG. 8).

The in-out actuator 78 may be operable to move the in-out carriage 72 along the in-out axis 66 a maximum of approximately 20 inches, approximately 22 inches, approximately 25 inches, or more. In some embodiments, this movement along the in-out axis 66 may allow the ball holder 12 and the ball 13 to move to a location that overhangs the home plate profile by approximately 2 inches, on either the left or right sides of the home plate (and any location in-between). The in-out actuator 78 may move the in-out carriage 72 at any speed. For example, the in-out actuator 78 may move the in-out carriage 72 at a speed of approximately 4 inches per second, although other actuation rates may be used. In some embodiments, the in-out actuator 78 may move the in-out carriage 72 at a speed that allows the in-out carriage 72 to reach the next random in-out position within approximately 5 seconds of the ball being hit off the ball holder 12.

The horizontal tee system 64 may also include a front-back actuator 80 operable to move the front-back carriage 74 along the front-back axis 68 relative to the base 70. This allows the front-back carriage 74 (and hence the ball holder 12 and the ball 13) to move back and forth between the front-side of the strike zone and the back-side of the strike zone. The front-back actuator 80 may be any type of system that may move the front-back carriage 74 along the front-back axis 68. For example, the front-back actuator 80 may be a mechanical system, an electro-mechanical system, a hydraulic system, a pneumatic system, or any other system that may move the front-back carriage 74 along the front-back axis 68. As is illustrated, the front-back actuator 80 is a mechanical belt system that moves the front-back carriage 74 along the front-back axis 68. This mechanical belt system may include a belt (such as a timing belt) connected to two or more rotating shafts. The movement of the mechanical belt system may be automatically driven by one or more motors 81 (shown in FIG. 8).

The front-back actuator 80 may be operable to move the front-back carriage 74 along the front-back axis 68 relative to the base 70 a maximum of approximately 10 inches, approximately 13 inches, approximately 15 inches, or more. Furthermore, in some embodiments, the front-back actuator 80 may be operable to move the front-back carriage 74 to a location that is forward of the home plate profile by approximately 10 inches. The front-back actuator 80 may move the front-back carriage 74 at any speed. For example, the front-back actuator 80 may move the front-back carriage 74 at a speed of approximately 4 inches per second, although other actuation rates may be used. In some embodiments, the front-back actuator 80 may move the front-back carriage 74 at a speed that allows the front-back carriage 74 to reach the next random front-back position within approximately 5 seconds of the ball being hit off the ball holder 12.

Each of the in-out actuator 78, the front-back actuator 80, and the actuator 30 may allow for movement independent of each other. For example, the in-out actuator 78 may be able to move the in-out carriage 72 without either the neck 10 or the front-back carriage 74 being moved by their respective actuators 30, 80. To do so, each of the in-out actuator 78, the front-back actuator 80, and the actuator 30 may include individual motors that only drive their respective actuator 78, 80, 30.

The tee system 2 (and the horizontal tee system 64 and the vertical tee system 3) may also include one or more connectors 9 that may couple the vertical tee system 3 to the horizontal tee system 64. That is, the connectors 9 may allow the vertical tee system 3 to be mounted on the front-back carriage 78 of the horizontal tee system 64.

The connectors 9 may be any type of connector that may couple the vertical tee system 3 to the horizontal tee system 64. For example, the connectors 9 may be a clip system, a magnetic connector system, bolts and nuts, a threaded connector system that allows the vertical tee system 3 to be screwed into the horizontal tee system 64, adhesives, bolts, compression fittings, brackets, a rail and groove system, a clamp system, any other type of connector, or any combination of the preceding.

As is illustrated in FIGS. 5-7, the connectors 9 are a quick release clip system. The quick release clip system may include a latch 11*a*, a first bracket 11*b* (shown in FIG. 1), and a second bracket 11*c*. To connect the vertical tee system 3 to the horizontal tee system 64, the vertical tee system 3 may be positioned on the front-back carriage 74 so that the second bracket 11*c* is positioned in a groove (not shown) in the bottom portion 6 of the housing 8 of the vertical tee system 3. Also, the first bracket 11*b* may be positioned underneath the latch 11*a*, and the latch 11*a* may then be closed over the first bracket 11*b*. This may allow the vertical tee system 3 to snap into connection with the horizontal tee system 64 with relative ease and stay locked even under forces hitting the tee until the mechanical release is actuated. To release the vertical tee system 3 from the horizontal tee system 64, the above process may be reversed. As is illustrated, the latch 11*a* and the second bracket 11*c* are included on the front-back carriage 74 of the horizontal tee system 64, while the first bracket 11*b* is included on the body 4 of the vertical tee stand 3. In other embodiments, the latch 11*a* and the second bracket 11*c* may be included on the body 4 of the vertical tee stand 3, while the first bracket 11*b* may be included on the front-back carriage 74 of the horizontal tee system 64.

In some embodiments, the connectors 9 may releasably couple the vertical tee system 3 to the horizontal tee system 64. In such embodiments, the vertical tee system 3 may be temporarily coupled to the horizontal tee system 64, and then the vertical tee system 3 may be removed from the horizontal tee system 64. This coupling and removal may occur any number of times. In some embodiments, when the vertical tee system 3 is removed, it may be used by itself. That is, a user may place the bottom portion 6 of the housing 8 of the vertical tee system 3 on a ground surface, and the vertical tee system 3 may remain stable while in use. In some embodiments, when the vertical tee system 3 is removed, it may be used with the tee stand 7 (discussed above). That is, a user can couple the vertical tee system 3 to the horizontal tee system 64 when the user desires movement (e.g., random movement) in three axes. Then, the user can remove the vertical tee system 3 and use it alone (or use it with the tee stand 7) when the user desires only movement (e.g., random movement) in the vertical axis 16.

Figure 8:
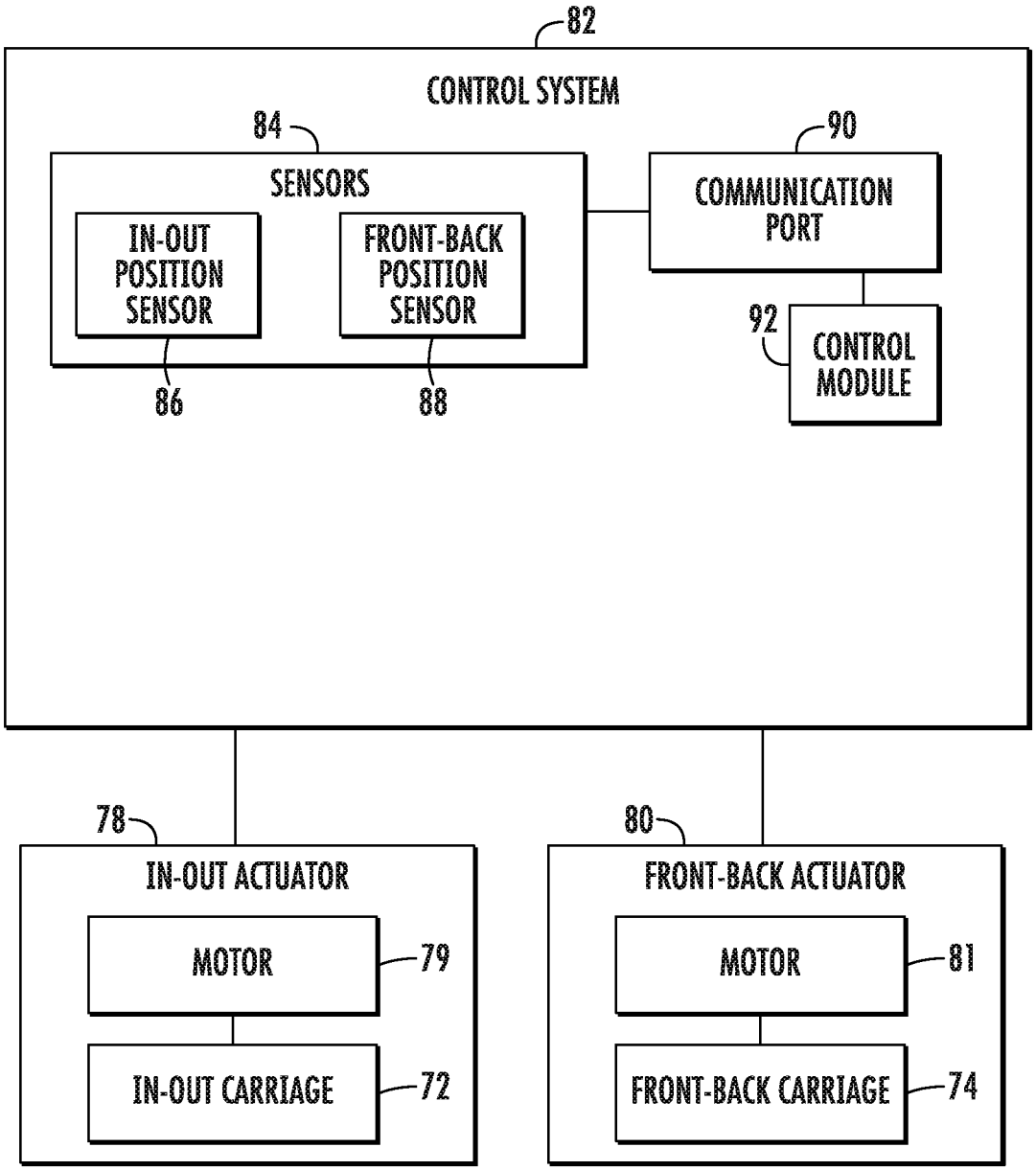
FIG. 8 schematically illustrates various operational features of the horizontal tee system of FIG. 5.

The horizontal tee system 64 may further include a control system 82 operable to control the operations of the horizontal tee system 64. With further reference to FIG. 8, schematically illustrating features of the control system 82 according to various embodiments, the control system 82 may provide for actuation (motor control) of the in-out carriage 72 along the in-out axis 66, actuation (motor control) of the front-back carriage 74 along the front-back axis 68, sensing using sensors 84, and communicating with other devices (e.g., the control system 40 of the vertical tee system 3) using the communication port 90. For example, the control system 82 may include sensors 84 comprising in-out position sensors 86 and front-back position sensors 88 (or the control system 82 may be configured to receive, via wired or wireless communication, position data from one or more in-out position sensors 86 and front-back position sensors 88) positioned to collect position data that may be used by the control system 82 to determine a position corresponding to the position of in-out carriage 72 and the front-back carriage 74. In some embodiments, the control system 82 and actuators 78 and 80 comprise servomechanisms. In one embodiment, the position sensors 86 and 88 include a potentiometer to monitor the rotation of a disc drive of the motors 79 and 81 which correspond to the in-out position of the in-out carriage 72 or the front-back position of the front-back carriage 74. The potentiometer may be a multi-turn potentiometer, for example, providing for simple determination of the in-out or front-back position of the carriages 72 and 74 (and hence the ball holder 12) at any point in time after being powered ON. In this or another embodiment, the control system 82 incorporates one or more stepper motors or servomotors configured with position control incorporating an encoder or potentiometer in a closed loop. In some embodiments, a slotted disc may be placed on the drive pin of the motor 79, 81, before the gear reduction. A photointerruptor may sense the slots of the disc, thus creating a motor encoder. The output of this motor encoder may be used to provide feedback to the classical control loops regulating motor speed and tee position. The control system 82 may also include a PID controller, for example, to receive and interpret the position data and provide corresponding control signals to control operation of the in-out actuator 78 and front-back actuator 80.

In some embodiments, sensors 84 may include more than one in-out position sensor 86 and/or more than one front-back position sensor 88. For example, sensors 84 may include two in-out position sensors 86 and/or two front-back position sensors 88. The additional sensors 84 may provide a fail-safe system that allows the control system 82 to still receive data even when a sensor 84 fails.

In various embodiments, the control system 82 includes a control module 92. The control module 92 may include a processor configured to execute instructions, which may be hardwired into the processor. The control module 92 may also include memory for storing instructions executable by the processor. For example, the control module 92 may comprise a microcontroller chip with general purpose I/O. Operational embedded software may be programmed to generate random in-out positions to move the in-out carriage 72 to, and to generate random front-back positions to move the front-back carriage 74 to. The control module 92 may also include a microcontroller board to interface with the actuators 78 and 80, sensors 86 and 88, and the control system 40 of the vertical tee system 3, and perform high level control of the horizontal tee system 64.

As is illustrated, the control system 82 may not include a user interface. Instead, a user may utilize the local user interface 50 of the vertical tee system 3 or the remote interface 56 (e.g., using an application on a mobile device) to input data for the horizontal tee system 64, as is discussed below. Although the control system 82 may not include a user interface, it may include a power switch that turns the horizontal tee system 64 ON and OFF. In other embodiments, the control system 82 may include a user interface similar to that discussed herein with regard to the vertical tee system 3. This user interface may be used to input data for the horizontal tee system 64, the vertical tee system 3, or both.

The control system 82 may also include a communication port 90, which may include multiple communication ports 90. The communication port 90 may include a receiver, transmitter, transceiver, etc. The communication port 90 may be configured to allow communication between the control system 82 and other devices, such as sensors 84, external or remote devices or interfaces 44 (e.g., an accessory device, wired or wirelessly coupled to the communication port 90), or the vertical tee system 3 (e.g., the control system 40 of the vertical tee system 3). For example, the communication port 90 may comprise a transceiver configured for wired communication, wireless communication, or both. In one embodiment, the communication port 90 is configured for wireless communication such as Bluetooth, IR, Wi-Fi, radio, etc.

In the illustrated embodiment, the communication port 90 receives a portion of the operational data from the control system 40 of the vertical tee system 3. For example, the vertical tee system 3 may send strike zone data for a particular user to the communication port 90 and the control system 82. This strike zone data may specify an in-out strike zone (e.g., the maximum left position of the strike zone and the maximum right position of the strike zone) for the particular user, and may further specify a front-back strike zone (e.g., the maximum front position of the strike zone and the maximum back position of the strike zone) for the particular user. The control system 82 may then utilize this strike zone data to move the carriages 72, 74 to positions within the strike zone.

A user may utilize the local user interface 50 (of the vertical tee system 3) or the remote interface 56 (e.g., using an application on a mobile device) to specify the strike zone for the particular user. For example, when the vertical tee system 3 is mounted on the horizontal tee system 64, the user interface 44 of the vertical tee system 3 may allow a user to specify the strike zone for the horizontal tee system 64. As an example of this, after the user has specified a height strike zone (discussed above), the user may have the option to specify an in-out strike zone. The user may touch an UP and DOWN button to move the in-out carriage 74 to the left. When the in-out carriage 74 is in the desired location, the user may touch a SET STRIKE ZONE button to indicate that this point should be the left-most position of the strike zone. Similarly, the user will be able to move the in-out carriage 74 to another point and set that as the right-most position of the strike zone using the SET STRIKE ZONE button. This may then be repeated in a similar way for the front-back strike zone. The set strike zone may be saved for that user. It may also be transmitted to the horizontal tee system 64 to be saved and used.

As another example of operational data, the vertical tee system 3 may send user identity data to the communication port 90 and the control system 82. This may allow the control system 82 to identify the user that is using the tee system 2, and to retrieve the saved strike zone data for that user.

As a further example of operational data, the vertical tee system 3 may send stop data to the communication port 90 and the control system 82. This may allow cause the control system 82 to stop all movement of the carriages 72 and 74.

In some embodiments, the stop data may be transmitted in response to the vertical tee system 3 determining that tee system 2 has tipped over, based on data from the tilt detection sensor 60. As such, the horizontal tee system 64 may not need (or even have) a tilt detection sensor. Instead, the horizontal tee system 64 may only move when instructed to by the vertical tee system 3. In other embodiments, the horizontal tee system 64 may include a tilt detection sensor.

As another example of operational data, the vertical tee system 3 may send movement data to the communication port 90 and the control system 82. This may cause the horizontal tee system 64 to move the carriages 72 and 74 (and hence the ball holder 12 of the vertical tee system 3) to a new position. As an example of this, the vertical tee system 3 may send movement data in the form of positional data. This positional data may cause the horizontal tee system 64 to move the carriages 72 and 74 (and hence the ball holder 12) to the position specified by the positional data. As another example, the vertical tee system 3 may send movement data in the form of movement commands. These movement commands may cause the horizontal tee system 64 to start moving the carriages 72 and 74 (and hence the ball holder 12) until a stop command is received from the vertical tee system 3 or until the boundary of the strike zone is met. For example, the movement command may cause the in-out carriage 72 to move to the left until a stop command is received from the vertical tee system 3 or until the left-most position of the strike zone for that user is met.

As a further example, the vertical tee system 3 may send movement data in the form of a randomization command. This randomization command may cause the control system 82 to generate a random in-and-out position and/or a random front-and-back position within the strike zone data for that user, and may then cause the control system 82 to cause the carriages 72, 74 to move to those random positions. The control system 82 may include a randomization software package so that the actuators 78, 80 do not move the carriages 72, 74 to the same position consecutively. The software package may include a random position generator operable to generate random positions within a defined range. As noted above, in one embodiment, the control system 82 may be programmed with random position sequences that may be executed during operation of the horizontal tee system 64. In one embodiment, the control system 82 will not allow a user to keep the carriages 72, 74 at the same position for more than one hit with the idea that a batter should not hit a ball in the same consecutive spot. In some embodiments, a user may utilize the local user interface 50 or the remote user interface 56 (e.g., a smart phone application) to create a pre-set number of positions for the ball holder 12. In such an example, the control system 40 may randomly circulate through the pre-set positions (as opposed to generating random positions).

In some embodiments, a user may utilize the local user interface 50 or the remote user interface 56 (e.g., a smart phone application) to control the position of the ball holder 12. In such an example, the position may not be random. Instead, the position may be input by the user into the local user interface 50 or the remote user interface 56 (e.g., pressing the UP or DOWN buttons, entering a particular position, downloading or entering a set of positions, etc.), thereby allowing the user to select the position of the ball holder 12. The ball holder 12 may then be moved to that position by the vertical tee system 3 and/or the horizontal tee system 64. In some embodiments, the user may select the position (and cause the ball holder 12 to be moved to that position) at any time. For example, the user may select the position (and cause the ball holder 12 to be moved to that position) after the ball has been hit from the ball holder 12, while the ball is still on the ball holder 12, or at any other time.

As is discussed above, the vertical tee system 3 may send movement data to the communication port 90 and the control system 82. This transmittal of movement data may be in response the control system 40 of the vertical tee system 3 determining that a ball has been hit, based on data from the ball presence sensor 58. As such, the horizontal tee system 64 may not need (or even have) a ball presence sensor. Instead, the horizontal tee system 64 may only move when instructed to by the vertical tee system 3. In other embodiments, the horizontal tee system 64 may include a ball presence sensor.

In addition to transmitting movement data to the communication port 90 and the control system 82, the control system 40 of the vertical tee system 3 may also cause the neck 10 to move. As such, the neck 10 may move upward or downward at approximately the same time as the carriages 72, 74 are moving left or right and/or front or back. This may cause the ball holder 12 to move in three axes to a new position (e.g., a new random position) after the ball is hit. In some embodiments, the ball holder 12 does not always move in three axes to a new position. For example, the new position may have the same height and same in-out position, but may have a new front-back position. In such an example, the ball holder 12 may only move in one axis to the new position. In other examples, the ball holder 12 may only move in two axes to the new position.

In one embodiment, the tee system 2 is a compact, three axes, robotic tee. The tee system 2 is low weight for easy positioning and transport. The control system 40 of the vertical tee system 3 controls the actuator 30 such that the telescoping neck 10 may be moved to a particular random height that is set between the minimum and maximum height that is pre-programmed into the control system 40 at the user interface 44. Similarly, the control system 82 of the horizontal tee system 64 controls the in-out actuator 78 such that the carriages 72, 74 may be moved to a particular random in-out position that is set between the left-most and right-most strike zone that is pre-programmed into the control system 40 at the user interface 44, and further controls the front-back actuator 80 such that the front-back carriage 74 may be moved to a particular random front-back position that is set between the front-most and back-most strike zone that is pre-programmed into the control system 40 at the user interface 44. The user places a ball on the tee and hits. An appropriate ball presence sensor 58 collects ball presence data which is used by the control module 48 to determine that the ball was hit. The control module 48 then initiates the actuator 30 to move the neck 10 along the vertical axis 16 to another random spot. Furthermore, the control module 48 causes the control module 92 to initiate the actuators 78, 80 to move the carriages 72, 74 along the in-out axis 66 and/or front-back axis 68 to another random spot. This allows random movement in three axes. Once the session is finished, the vertical tee system 3 may be detached from its mounting on the horizontal tee system 64. The vertical tee system 3 may then be used on its own, used with a tee stand 7, or stored away until its next use.

Figure 9:
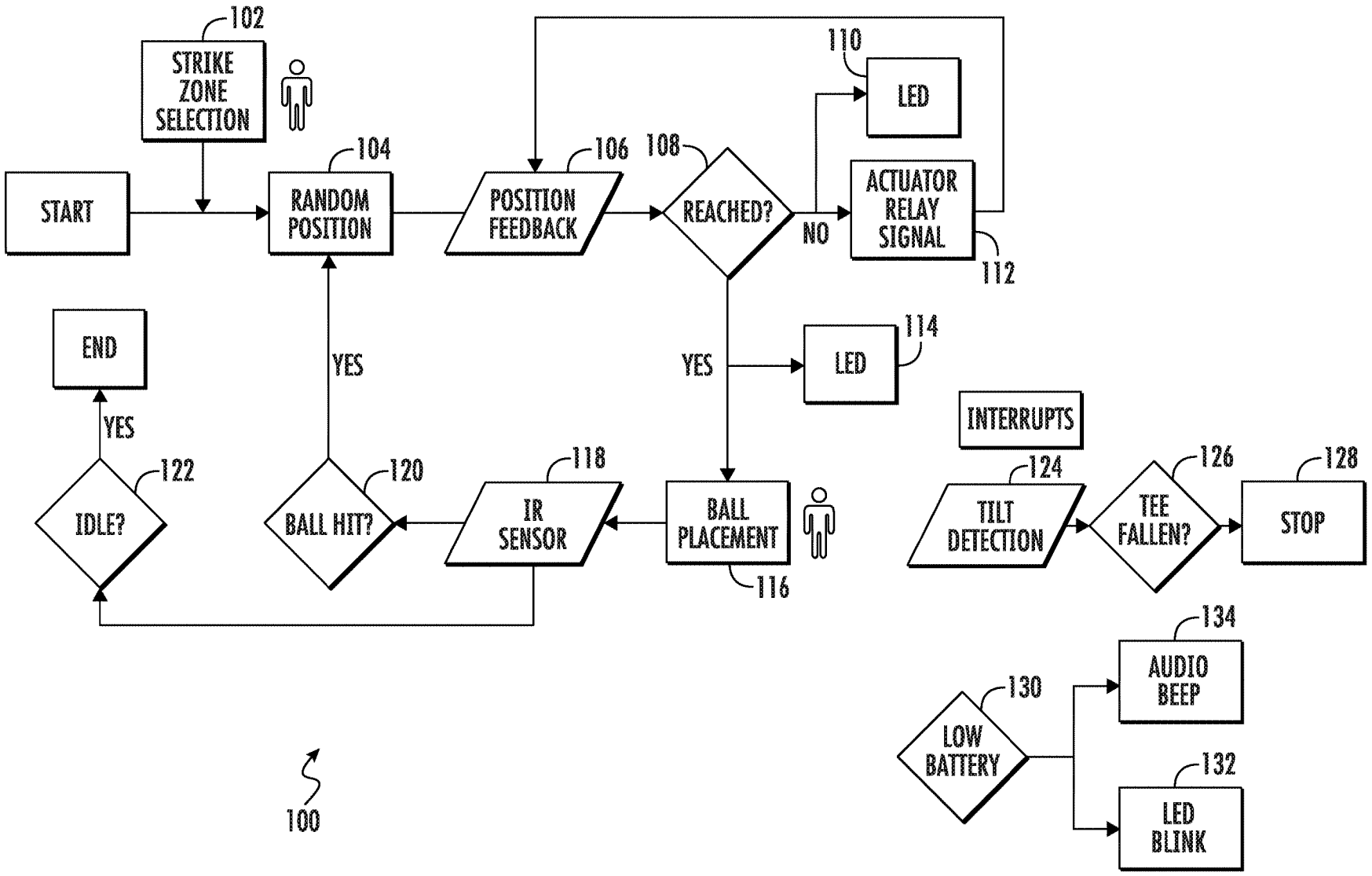
FIG. 9 is a flowchart illustrating one embodiment of the operation of the tee system of FIG. 7.

FIG. 9 is a flowchart depicting an example operation 100 of the tee system 2 according to various embodiments. As shown in FIG. 9, and with further reference to FIGS. 1-8, the control system 40 initially receives strike zone selections 103 from a user, which may be entered or selected at a user interface 44 and includes a minimum and maximum height, a left-most and right-most position of the strike zone (i.e., in-out position), and/or a front-most and back-most position of the strike zone. The user may set the ranges locally at a local user interface 50 or remotely at a remote interface 56, which is generally based on the height of the user, stance, and strike zone, such as major league strike zone rules. The actuators 30, 78, and 80 may move the neck 10, in-out carriage 72, and front-back carriage 74 (and hence the ball holder 12) to a random position 104 within the set ranges. Position sensors 46, 86, and 88 may detect position data and provide position feedback 106 to the control modules 48 and 92, which determine if the position has been reached 108. If the position has not been reached, an indicator display 52 emits a red light 110 and the actuators 30, 78, and 80 are signaled 112 to move or continue to move the neck 10, in-out carriage 72, and front-back carriage 74 (and hence the ball holder 12). On the other hand, if the position has been reached, an indicator display 52 emits a green light 114, indicating that the user may place the ball 116 on the ball holder 12. A ball presence sensor 58, an IR sensor 118 in the flowchart, may be used to detect ball presence data and provide the ball presence data to the control module 48. If the ball presence data indicates that the ball has been hit 120, the actuators 30, 78, and 80 move the neck 10, in-out carriage 72, and front-back carriage 74 (and hence the ball holder 12) to the next random position 104 within the range set at 102. If the ball presence data does not indicate that the ball has been hit 120, the control module 48 idles 122 until ball presence data indicates the ball has been hit 120. The operation loop may include interrupts (e.g., powering off, user indicating new program or session, etc.). FIG. 9 includes two interrupts. At 124, the tilt detection sensor 60 detects tilt data and provides it to the control module 48. The control module 48 interprets the tilt data to determine if the body 4 has fallen 126. If the control module 48 determines that the body 4 has fallen, the control module 48 signals the actuator 30 and the control module 92 (and hence actuators 78 and 80) to stop 128. The control system 40 may also be configured to detect low battery power. If the control module 48 detects low batter power 130, the control module 48 may display a blinking LED 132, emit an audio beep 134 through a speaker, or both.

It will be appreciated that the embodiments described herein may include additional or fewer features and components, and may further include modifications. Similarly, the present disclosure is not intended to be limited by the specific embodiments described as those having skill in the art upon reading this disclosure will understand that the teachings herein may be applied to in various ways to batting tee systems.

For example, in some embodiments, the vertical tee system 3 and the horizontal tee system 64 may be formed as a single device. That is, they may not be detached from each other. As a further example, in some embodiments, the horizontal tee system 64 may not include two carriages 72 and 74. Instead, the horizontal tee system 64 may include a single carriage that may be moved both along the in-out axis 66 and the front-back axis 68. As an example of this, the horizontal tee system 64 may include a set of moveable arms that move a single carriage both along the in-out axis 66 and the front-back axis 68. As another example, in some embodiments, the vertical tee system 3 coupled to the horizontal tee system 64 may not have an extendable neck 10. Instead, it may have a ball holder 12 that remains at the same height. In such an example, the horizontal tee system 64 may have a user interface that allows data to be input into the horizontal tee system 64.

As a further example, in some embodiments, the vertical tee system 3 may further include or incorporate a location indicator system that may project a light on a batting net illuminating a goal location toward which the batter is to attempt to direct the ball. This projection may be simultaneous to or close in time with each random positional movement of the ball holder 12. Once the ball is hit, the ball holder 12 will move to another random spot along the axes 16, 66, and/or 68, and the light will be projected on another random spot on the net. This exercise will instruct situational hitting and further reinforce longer term learning through the randomization process. Further details regarding an example of the location indicator system are described in U.S. Pat. No. 10,112,097 entitled "Robotic batting tee system", which is incorporated herein by reference.

Any references to "various embodiments," "certain embodiments," "some embodiments," "one example," "one embodiment," "an example," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not necessarily refer to the same embodiment. Furthermore, the phrases "in one such embodiment" or "in certain such embodiments," or "in one example," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise. Additionally, the grammatical conjunctions "and" and "or" are used herein according to their accepted usage. By way of example, "x and y" refers to "x" and "y". On the other hand, "x or y" refers to "x", "y", or both "x" and "y", whereas "either x or y" refers to exclusivity.

What is claimed is:

1. A batting tee system, comprising:

a vertical tee system comprising:

a housing;

a ball holder for holding a ball;

a neck movable along a vertical axis, the neck coupled at a first end to the housing, and further coupled at a second end to the ball holder;

a first actuator positioned in the housing and operable to move the neck along the vertical axis thereby increasing and decreasing a distance between the ball holder and the housing;

a first control system operable to cause the first actuator to move the neck to a first random position along the vertical axis, wherein the control system is further operable to cause the first actuator to move the neck from the first random position along the vertical axis to a second random position along the vertical axis, different than the first random position along the vertical axis, after the ball is hit from the ball holder when the neck is in the first random position along the vertical axis;

a horizontal tee system comprising:

a base;

a first carriage moveably coupled to the base;

a second carriage moveably coupled to the first carriage, the second carriage operable to hold the vertical tee system;

a second actuator coupled to the base and operable to move the first carriage and the second carriage along a first horizontal axis relative to the base;

a third actuator coupled to the first carriage and operable to move the second carriage along a second horizontal axis relative to the base and the first carriage; and a second control system operable to:

cause the second actuator to move the first carriage and the second carriage to a first random position along the first horizontal axis;

cause the third actuator to move the second carriage to a first random position along the second horizontal axis;

cause the second actuator to move the first carriage and the second carriage from the first random position along the first horizontal axis to a second random position along the first horizontal axis, different than the first random position along the first horizontal axis, after the ball is hit from the ball holder when the first carriage and the second carriage are in the first random position along the first horizontal axis; and cause the third actuator to move the second carriage from the first random position along the second horizontal axis to a second random position along the second horizontal axis, different than the first random position along the second horizontal axis, after the ball is hit from the ball holder when the second carriage is in the first random position along the second horizontal axis; and one or more connectors operable to releasably couple the vertical tee system to the second carriage of the horizontal tee system.

2. The system of claim 1, wherein:

the first carriage is an in-out carriage;

the second carriage is a front-back carriage;

the second actuator is operable to move the in-out carriage and the front-back carriage along an in-out axis relative to the base; and the third actuator is operable to move the front-back carriage along a front-back axis relative to the base and the in-out carriage.

3. The system of claim 1, wherein:

the first carriage is a front-back carriage;

the second carriage is an in-out carriage;

the second actuator is operable to move the front-back carriage and the in-out carriage along a front-back axis relative to the base; and the third actuator is operable to move the in-out carriage along an in-out axis relative to the base and the front-back carriage.

4. The system of claim 1, wherein the one or more connectors comprise a quick release clip system.

5. The system of claim 1, wherein the first actuator comprises a spool rotatable by a motor, and further comprises plastic tape coupled at a first end to the spool and further coupled at a second end to a portion of the neck.

6. The system of claim 1, wherein the second actuator and the third actuator each comprise a belt connected to two or more rotating shafts.

7. The system of claim 1, wherein:

the first control system is further operable to cause the first actuator to move the neck from the second random position along the vertical axis to a third position that is selected by a user, that is along the vertical axis, and that is different than the second random position along the vertical axis, after the ball is hit from the ball holder when the neck is in the second random position along the vertical axis; and the second control system is further operable to:

cause the second actuator to move the first carriage and the second carriage from the second random position along the first horizontal axis to a third position that is selected by a user, that is along the first horizontal axis, and that is different than the second random position along the first horizontal axis, after the ball is hit from the ball holder when the first carriage and the second carriage are in the second random position along the first horizontal axis; and cause the third actuator to move the second carriage from the second random position along the second horizontal axis to a third position that is selected by the user, that is along the second horizontal axis, and that is different than the second random position along the second horizontal axis, after the ball is hit from the ball holder when the second carriage is in the second random position along the second horizontal axis.

8. The system of claim 1, wherein:

the neck is operable to be moved manually by a user from the second position along the vertical axis to a third position along the vertical axis;

the first and second carriage are further operable to be moved manually by the user from the second position along the first horizontal axis to a third position along the first horizontal axis; and the second carriage is further operable to be moved manually by the user from the second position along the second horizontal axis to a third position along the second horizontal axis.

9. The system of claim 1, wherein the first control system comprises one or more ball presence sensors positioned to collect ball presence data that the first control system analyzes to determine if the ball has been hit from the ball holder.

10. A batting tee system, comprising:

a vertical tee system comprising:

a housing;

a ball holder for holding a ball;

a neck movable along a vertical axis, the neck coupled at a first end to the housing, and further coupled at a second end to the ball holder;

a first actuator positioned in the housing and operable to move the neck along the vertical axis thereby increasing and decreasing a distance between the ball holder and the housing;

a first control system operable to cause the first actuator to move the neck to a first position along the vertical axis, wherein the control system is further operable to cause the first actuator to move the neck from the first position along the vertical axis to a second position along the vertical axis, different than the first position along the vertical axis, after the ball is hit from the ball holder when the neck is in the first position along the vertical axis;

a horizontal tee system comprising:

a base;

a first carriage moveably coupled to the base;

a second carriage moveably coupled to the first carriage, the second carriage operable to hold the vertical tee system;

a second actuator coupled to the base and operable to move the first carriage and the second carriage along a first horizontal axis relative to the base;

a third actuator coupled to the first carriage and operable to move the second carriage along a second horizontal axis relative to the base and the first carriage; and a second control system operable to:

cause the second actuator to move the first carriage and the second carriage to a first position along the first horizontal axis;

cause the third actuator to move the second carriage to a first position along the second horizontal axis;

cause the second actuator to move the first carriage and the second carriage from the first position along the first horizontal axis to a second position along the first horizontal axis, different than the first position along the first horizontal axis, after the ball is hit from the ball holder when the first carriage and the second carriage are in the first position along the first horizontal axis; and cause the third actuator to move the second carriage from the first position along the second horizontal axis to a second position along the second horizontal axis, different than the first position along the second horizontal axis, after the ball is hit from the ball holder when the second carriage is in the first position along the second horizontal axis; and one or more connectors operable to releasably couple the vertical tee system to the second carriage of the horizontal tee system.

11. The system of claim 10, wherein:

the first position along the vertical axis comprises a first position that is along the vertical axis and that is selected by a user;

the first position along the first horizontal axis comprises a first position that is along the first horizontal axis and that is selected by the user;

the first position along the second horizontal axis comprises a first position that is along the second horizontal axis and that is selected by the user;

the second position along the vertical axis comprises a second position that is along the vertical axis and that is selected by the user;

the second position along the first horizontal axis comprises a second position that is along the first horizontal axis and that is selected by the user; and the second position along the second horizontal axis comprises a second position that is along the second horizontal axis and that is selected by the user.

* * * * *